United States Patent [19]

Yamanouchi et al.

[11] Patent Number: 5,023,162

[45] Date of Patent: Jun. 11, 1991

[54] PHOTOGRAPHIC ELEMENT

[75] Inventors: Junichi Yamanouchi; Kentaro Shiratsuchi; Yukio Karino; Takeshi Shibata, all of Ashigara, Japan

[73] Assignee: Fuji Photo Film Co., Ltd., Kanagawa, Japan

[21] Appl. No.: 382,365

[22] Filed: Jul. 20, 1989

[30] Foreign Application Priority Data

Jul. 21, 1988 [JP] Japan ..... 63-182672

[51] Int. Cl.[5] ..... G03C 5/54

[52] U.S. Cl. ..... 430/203; 430/213; 430/518; 430/941

[58] Field of Search ..... 430/213, 518, 941, 203; 101/464; 428/500, 522

[56] References Cited

U.S. PATENT DOCUMENTS 4,396,698 8/1983 Katino et al. ..... 430/213

4,814,255 3/1989 Vanmaele et al. ..... 430/213

*Primary Examiner*—Richard L. Schilling

*Attorney, Agent, or Firm*—Sughrue, Mion, Zinn, Macpeak & Seas

[57] ABSTRACT

A photographic element comprising a polymer mordant containing a repeating unit containing a tertiary amino group or a quaternary ammonium salt and at least one reprating unit represented by the formula (I) or (II):

(I)

(II)

wherein $R^1$ represents a hydrogen atom or an alkyl group having from 1 to 6 carbon atoms $R^2$, $R^3$, $R^4$ and $R^5$, which may be the same or different, each represent an alkyl group or substituted alkyl group; $R^6$, $R^7$, and $R^8$, which may be the same or different, each represent hydrogen, an alkyl group or a substituted alkyl group; $R^{11}$ represents an alkyl group, a substituted alkyl group, an alkoxy group, a substituted alkoxy group, an acylamino group or a halogen atom; $R^{12}$ and $R^{13}$, which may be the same or different, each represent an alkyl group or a substituted alkyl group; $L^1$ and $L^3$, which may be the same or different, each represent a divalent connecting group having from 1 to 20 carbon atoms; and n represents an integer of 0 or 1, wherein the proportion of the repeating unit containing a tertiary amino group or a quaternary ammonium salt in the polymer is in the range of from 10 to 90 mol %, and the proportion of the at least one repeating unit represented by formula (I) or (II) in the polymer is in the range of of 10 to 90 mol %.

9 Claims, No Drawings

PHOTOGRAPHIC ELEMENT

FIELD OF THE INVENTION

The present invention relates to a photographic element. Particularly, the present invention relates to a novel polymer dye mordant for use in photographic elements and to a photographic element comprising the novel polymer.

The present invention further relates to a mordant for fixing diffusible dyes which have been imagewise formed and to a color photographic element comprising a layer containing the novel polymer mordant.

BACKGROUND OF THE INVENTION

In the field of photography, various polymers are commonly used as mordants in order to prevent the transfer of dyes.

Polymer mordants are disclosed in U.S. Pat. Nos. 3,898,088, 3,958,995, and 4,131,469, West German Patent Application Disclosure 2,941, and JP-A-53 30328, and JP-A-56-17352 (the term "JP-A" as used herein means an "unexamined published Japanese patent application").

In heat-developable light-sensitive materials as described in JP-A-58-58543, and JP-A-58-79247, and Japanese Patent Application Nos. 58-149046 and 58-149047, polymer mordants are employed for fixing anionic dyes.

However, these polymeric mordants exhibit excellent dye mordanting properties, but prove to be extremely poor with regard to preserving the dyes thus mordanted in a stable form.

In particular, a photographic system comprising a dye mordanted by this type of mordant has another disadvantage. When irradiated with light from a fluorescent tube or sunlight, the mordanted dye is susceptible to chemical change or decomposition.

On the other hand, polymer mordants wherein the mordanted dye is insensitive to chemical change or decomposition by light are disclosed in British Patents 2,011,921, 2,056,101, and 2,093,041, U.S. Pat. Nos. 4,115,124, 4,273,853, and JP-A-60-118834, JP-A-60-128443, JP-A-60 122940, JP-A-60 122921, and JP-A-60-235134. However, these mordants leave much to be desired.

Further, a process which comprises filling a polymeric mordant dispersion with a hydrophobic low molecular compound having discoloration inhibiting properties is disclosed in JP-A-57-202539. In this process, a polymeric mordant is impregnated with a compound having a proper hydrophibicity to provide a certain discoloration inhibiting effect.

However, the amount of the discoloration inhibiting compound which can be incorporated into the mordant according to this process is limited. Thus, a mordant having a further improved discoloration inhibiting capability has been desired.

In impregnating a latex with a discoloration inhibiting compound according to the process of JP-A-57-202539, the discoloration inhibitor is structurally limited. Thus, development of an effective process for fixing a discoloration inhibitor in a mordant layer has been desired.

SUMMARY OF THE INVENTION

An object of the present invention is to provide a photographic element comprising a polymer mordant having an excellent mordanting capability wherein the thus mordanted dye is not susceptible to discoloration due to light to thereby provide a mordanted dye having excellent preservability and light fastness.

The above and other objects of the present invention are apparent from the following detailed description and examples.

The objects of the present invention are accomplished with a photographic element comprising a polymer mordant containing a repeating unit containing a tertiary amino groups or quaternary ammonium salts and at least one repeating unit represented by formulae (I) or (II).

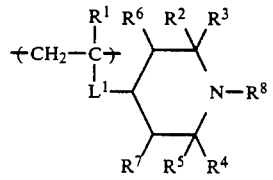

(I)

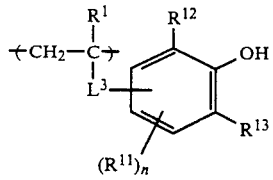

(II)

wherein $R^1$ represents hydrogen or a $C_{1-6}$ alkyl group (an alkyl group having from 1 to 6 carbon atoms); $R^2$, $R^3$, $R^4$ and $R^5$, which may be the same or different, each represents an alkyl group or substituted alkyl group; $R^6$, $R^7$ and $R^8$, which may be the same or different, each represent hydrogen, an alkyl group or substituted alkyl group; $R^{11}$ represents an alkyl group, substituted alkyl group, alkoxy group, substituted alkoxy group, acylamino group or halogen atom; $R^{12}$ and $R^{13}$, which may be the same or different, each represent an alkyl group or substituted alkyl group; $L^1$ and $L^3$, which may be the same or different, each represent a $C_{1-20}$ divalent connecting group; and n represents an integer 0 or 1.

The proportion of repeating units containing tertiary amino groups or quaternary ammonium salts in the polymer is in the range of from 10 to 90 mol%, and particularly 10 to 80 mol%. The proportion of the repeating units represented by formulae (I) or (II) in the polymer is in the range of from 10 to 90 mol%, and particularly 20 to 80 mol%.

The polymer mordant of the present invention is further described below.

In the polymer for use in the present invention, preferred examples of repeating units containing tertiary amino groups or quaternary ammonium salts include those represented by formulae (IV), (V), (VI) and (VII):

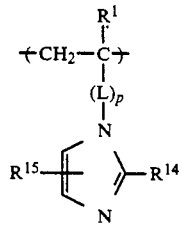

(IV)

wherein $R^1$, $R^{14}$ and $R^{15}$ each represent hydrogen or a $C_{1-6}$ alkyl group; L represents a $C_{1-20}$ divalent connecting group; and P represents an integer 0 r 1.

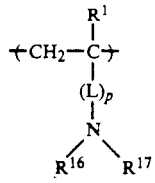

(V)

wherein $R^1$, L and P are as defined in the general formula (IV); and $R^{16}$ and $R^{17}$ may be the same or different and each represents a $C_{1-12}$ alkyl or substituted alkyl group, or $C_{7-20}$ aralkyl or substituted aralkyl group. $R^{16}$ and $R^{17}$ may be connected to each other to form a ring together with the nitrogen atom bonded thereto.

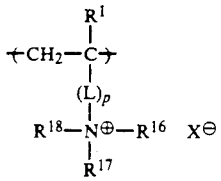

(VI)

wherein $R^1$, L, P, $R^{16}$ and $R^{17}$ are as defined in the general formulae (IV) and (V); $R^{18}$ has the same meaning as $R^{16}$ in the general formula (V); and $X^{\ominus}$ represents a monovalent anion. $R^{16}$ and $R^{17}$, $R^{16}$ and $R^{18}$, or $R^{17}$ and $R^{18}$ may be connected to each other to form a ring together with the nitrogen atom bonded thereto.

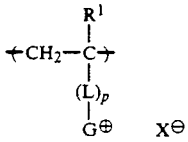

(VII)

wherein $R^1$, L, P and $X^{\ominus}$ are as defined in the general formulae (IV), (V) and (VI); and $G^{\oplus}$ represents a quaternized aromatic heterocyclic group.

In formula (IV), $R^1$, $R^{14}$ and $R^{15}$ each is preferably hydrogen or a $C_{1-6}$ lower alkyl group (e.g., methyl, ethyl, n-propyl, n-butyl, n-amyl, n-hexyl), and particularly hydrogen, a methyl group or ethyl group.

L represents a divalent connecting group containing from 1 to about 20 carbon atoms. This connecting group is particularly represented by the general formula $\text{-}(X^1)_p\text{-}(J^1\text{-}X^2)_q\text{-}(J^2\text{-}X^3)_r\text{-}(J^3\text{-}X^4)_s\text{-}(J^4)_t$. $X^1$, $X^2$, $X^3$ and $X^4$ may be the same or different. Examples of $X^1$, $X^2$, $X^3$ and $X^4$ include —COO—, —OCO—,

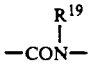

(wherein $R^{19}$ represents hydrogen, a $C_{1-6}$ alkyl group or $C_{1-6}$ substituted alkyl group), —CO—, —$SO_2$—,

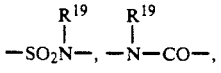

(wherein $R^{19}$ is as defined above),

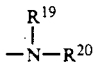

(wherein $R^{19}$ is as defined above: and $R^{20}$ represents an alkylene group or substituted alkylene group containing from 1 to about 4 carbon atoms),

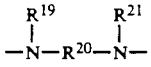

(wherein $R^{19}$ and $R^{20}$ are as defined above; and $R^{21}$ represents hydrogen, a $C_{1-6}$ alkyl group or $C_{1-6}$ substituted alkyl group), —O—, —S—,

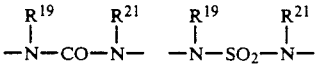

(wherein $R^{19}$ and $R^{21}$ are as defined above),

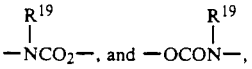

(wherein $R^{19}$ is as defined above).

$J^1$, $J^2$, $J^3$ and $J^4$ may be the same or different and each represents an alkylene group, substituted alkylene group, arylene group, substituted arylene group, aralkylene group or substituted aralkylene group. The suffixes p, q, r, s and t each represents an integer or 1.

Examples of substituents which may be further substituted, for the above described connecting group L include a halogen atom, cyano group, alkyl group, substituted alkyl group, alkoxy group, substituted alkoxy group, a group represented by —$NHCOR^{22}$ (wherein $R^{22}$ represents an alkyl group, substituted alkyl group, phenyl group, substituted phenyl group, aralkyl group or substituted aralkyl group), a group represented by —$NHSO_2R^{22}$ (wherein $R^{22}$ is as defined above), a group represented by —$COR^{22}$ (wherein $R^{22}$ is as defined above), a group represented by

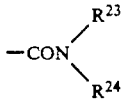

(wherein $R^{23}$ and $R^{24}$ may be the same or different and each represents hydrogen, an alkyl group, substituted alkyl group, phenyl group, substituted phenyl group, aralkyl group or substituted aralkyl group), a group represented by

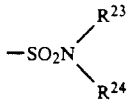

(wherein $R^{23}$ and $R^{24}$ are as defined above), an amino group which may be substituted by an alkyl group hydroxyl group, and groups which undergo hydrolysis to form a hydroxyl group.

Particularly preferred examples of the connecting group represented by L include an alkylene group (e.g., methylene, ethylene, trimethylene, hexamethylene), phenylene group (e.g., o-phenylene, p-phenylene, m-phenylene), arylenealkylene group (e.g.,

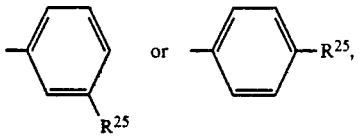

wherein $R^{25}$ represents an alkylene group having from 1 to about 12 carbon atoms), $—CO_2—R^{26}$, $—CONH—R^{26}—$ (wherein $R^{26}$ represents an alkylene group, phenylene group or arylenealkylene group), and

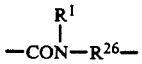

(wherein $R^1$ and $R^{26}$ are as defined above). Further preferred examples of the connecting group represented by L include

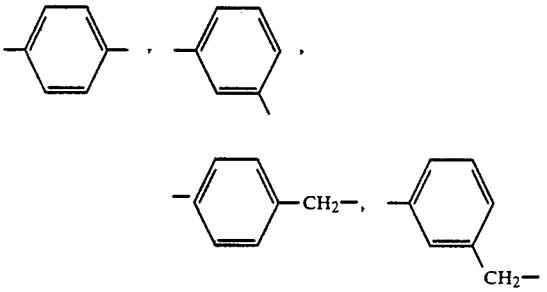

$—CH_2—$, $—CONH—$, $—CO_2—CH_2CH_2—$, $—CO_2—CH_2CH_2CH_2—$, $—CONHCH_2—$, $—CONHCH_2—CH_2—$, and $—CONHCH_2CH_2CH_2—$. Specific preferred examples of the repeating unit represented by the general formula (IV) are shown below:

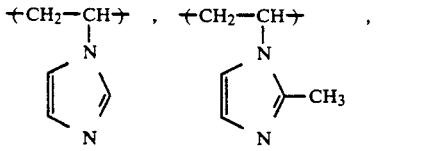

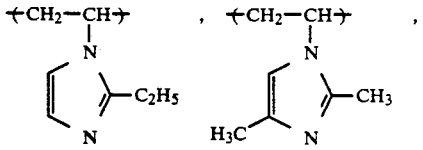

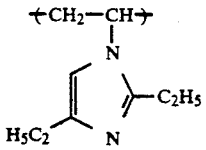

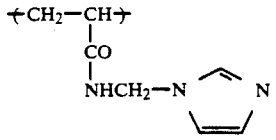

-continued

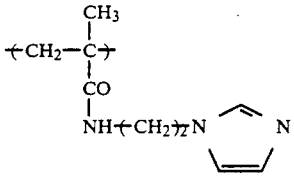

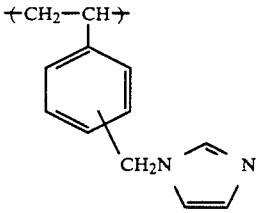

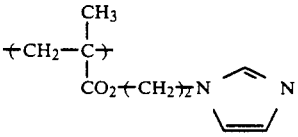

In the general formula (V), $R^{16}$ and $R^{17}$ represent a $C_{1-12}$ alkyl group (e.g., methyl, ethyl, n-propyl, n-butyl, n-amyl, hexyl, n-nonyl, n-decyl, n-dodecyl), or substituted alkyl group (e.g., methoxyethyl, 3-cyanopropyl, ethoxycarbonylethyl, acetoxyethyl, hydroxyethyl, 2-butenyl), or a $C_{7-20}$ aralkyl group (e.g., benzyl, phenetyl, diphenyl, naphthylmethyl), or substituted aralkyl group (e.g., 4-methylbenzyl, 4-isopropylbenzyl, 4-methoxybenzyl, 4-(4-methoxyphenyl)-benzyl, 3-chlorobenzyl).

Examples of the ring which $R^{16}$ and $R^{17}$ form together with the nitrogen atom bonded thereto include

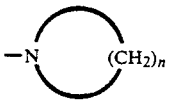

(wherein n represents an integer of from 4 to 12), and

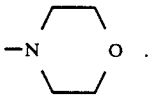

Specific preferred examples of the repeating units represented by formula (V) are shown below:

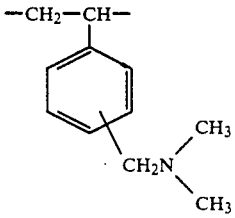

-continued

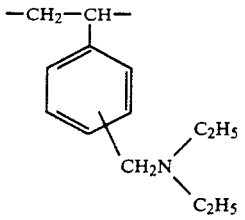

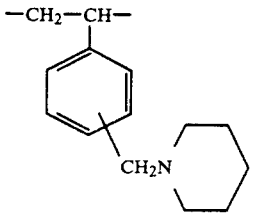

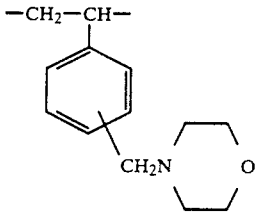

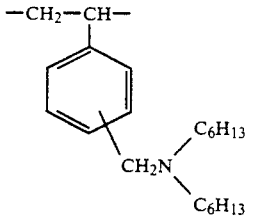

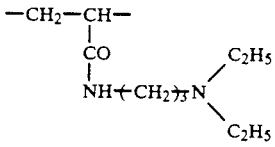

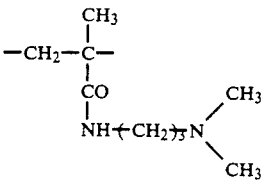

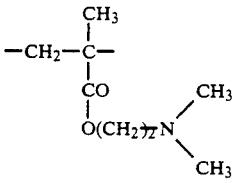

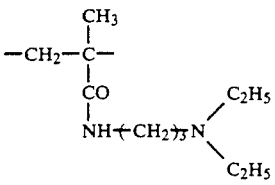

-continued

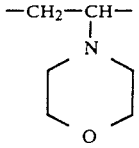

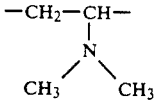

In formula (VI), examples of the ring which $R^{16}$ and $R^{17}$ form together with the nitrogen atom bonded thereto include

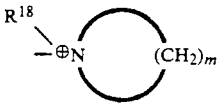

(wherein m represents an integer of from 4 to 12), and

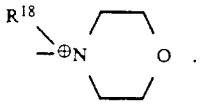

Examples of the ring which $R^{16}$, $R^{17}$ and $R^{18}$ form together with the nitrogen atom bonded thereto include

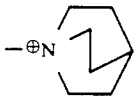

$X^{\ominus}$ represents an anion such as a halogen ion (e.g., a chloride ion, a bromide ion, an iodide ion), an alkyl sulfuric acid ion (e.g., a methylsulfuric acid ion, an ethylsulfuric acid ion), an alkyl or arylsulfonic acid ion (e.g., a methanesulfonic acid, an ethanesulfonic acid, a benzenesulfonic acid, a p-toluenesulfonic acid), an acetic acid ion, and a sulfuric acid ion. Particularly preferred among these anions are a chloride ion, and a p-toluenesulfonic acid ion.

Specific preferred examples of the repeating unit represented by formula (VI) are shown below:

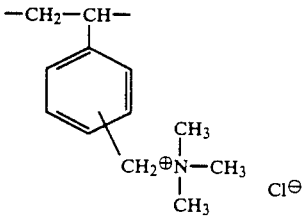

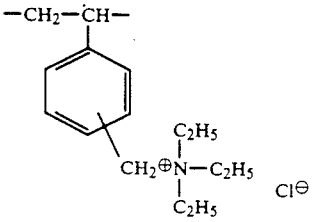

-continued

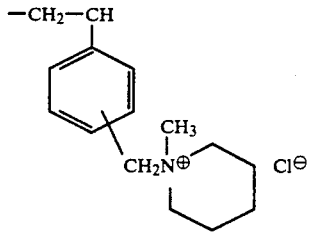

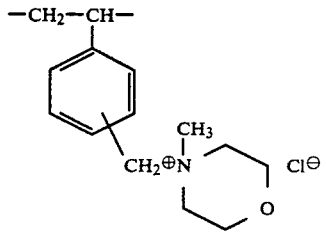

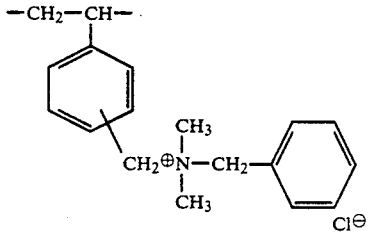

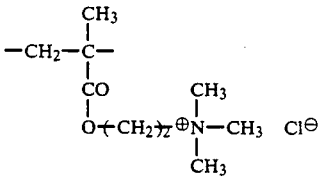

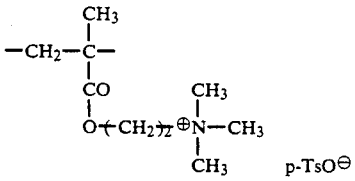

wherein p-TsO⊖ represents a p-toluenesulfonic acid anion.

In formula (VII), G⊕ represents a quaternized aromatic heterocyclic group. Examples of such a quaternized aromatic heterocyclic group include

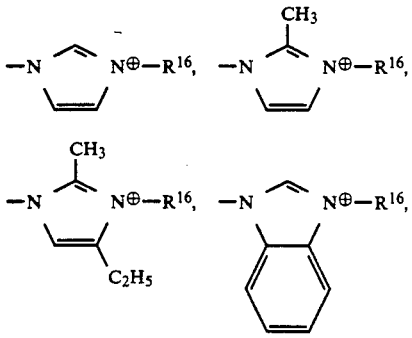

(wherein $R^{16}$ is as defined above), triazolium salts (e.g.,

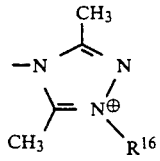

wherein $R^{16}$ is as defined above), and pyridinium salts

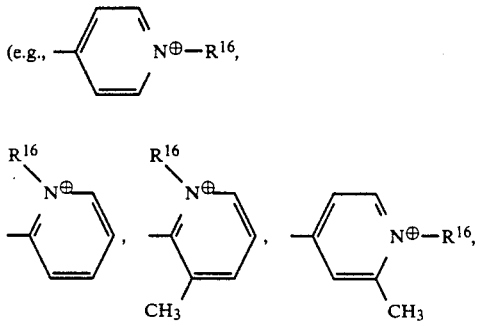

wherein $R^{16}$ is as defined above). Particularly preferred among these groups are imidazolium salts and pyridinium salts. $R^{16}$ is as defined in the general formula (V). Particularly preferred among the groups represented by $R^{16}$ as part of the quaternized aromatic heterocyclic group are methyl group, ethyl group and benzyl group.

Specific preferred examples of the repeating unit represented by the general formula (VII) are shown below:

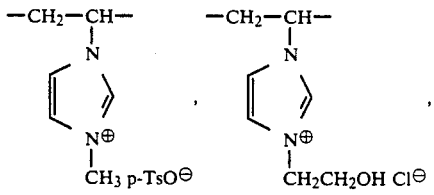

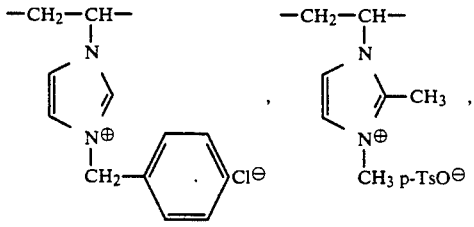

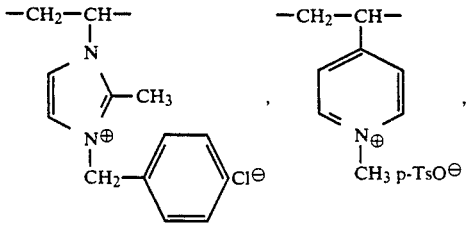

-continued

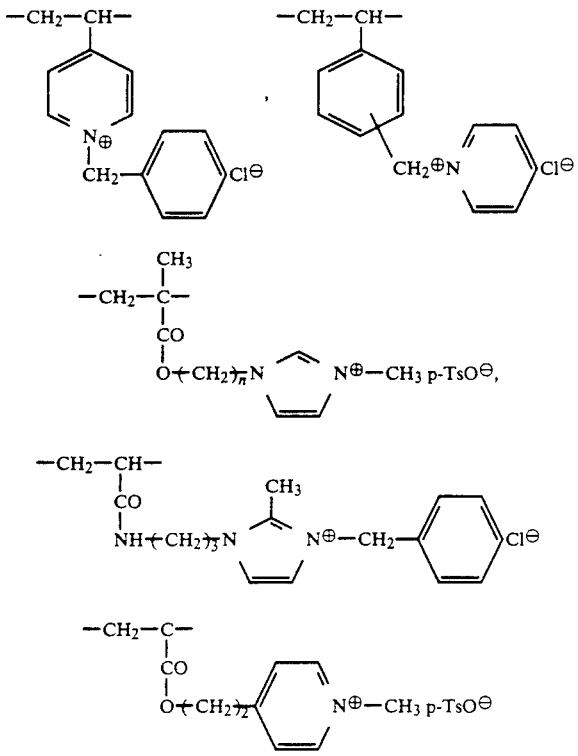

wherein p-TsO⊖ represents a p-toluenesulfonic acid anion.

The repeating units derived from the monomer units represented by the general formula (I) or (II) for use in the polymer of the present invention are described below.

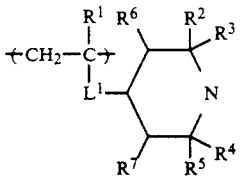

(I)

wherein $R^1$ is as defined in the general formula (IV); and $R^2$, $R^3$, $R^4$ and $R^5$ may be the same or different and each represents a $C_{1-6}$ lower alkyl group (e.g., methyl, ethyl, n-propyl, n-butyl, n-hexyl). Particularly preferred among these $C_{1-6}$ lower alkyl groups are a methyl group and an ethyl group.

$R^6$, $R^7$ and $R^8$ may be the same or different and each represents hydrogen, a $C_{1-10}$ alkyl group (e.g., methyl, ethyl, n-butyl, n-octyl) or a substituted alkyl group. Examples of the substituents for the substituted alkyl group include an alkoxyalkyl group (e.g., methoxyethyl), a cyanoalkyl group (e.g., 3-cyanopropyl), an alkoxycarbonylalkyl group (e.g., ethoxycarbonylmethyl), a halogenated alkyl group (e.g., 2-chloroethyl), and an aryl group.

Particularly preferred among those represented by $R^6$ and $R^7$ is hydrogen. Particularly preferred among those represented by $R^8$ are hydrogen, a methyl group and an ethyl group.

$L^1$ represents a divalent connecting group as defined by L in the general formulae (IV) to (VII).

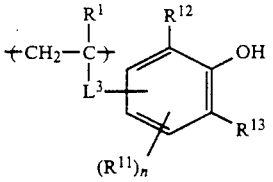

(II)

wherein $R^1$ is as defined in the general formula (IV); $R^{11}$ represents a $C_{1-10}$ alkyl group, a substituted alkyl group, an alkoxy group, a substituted alkoxy group, an acylamino group or a halogen atom; and $R^{12}$ and $R^{13}$ each represents a substituted or unsubstituted alkyl group, and a secondary or tertiary alkyl group (e.g., isopropyl, t-butyl, t-amyl) or a secondary or tertiary substituted alkyl group, the substituents may be the same substituents as defined for $L^1$ in formula (I). Particularly preferred among these groups for $R^{12}$ and $R^{13}$ is a tertiary alkyl group.

$L^3$ represents a divalent connecting group as defined by L in the general formulae (IV) to (VII), and suffix n represents an integer of 0 or 1.

Preferred examples of the repeating units derived from the monomer units represented by formula (I) are shown below, but the present invention is not limited thereto.

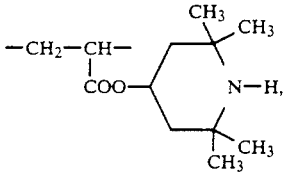

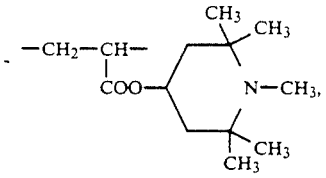

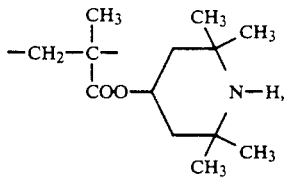

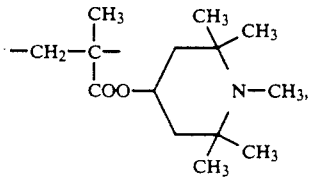

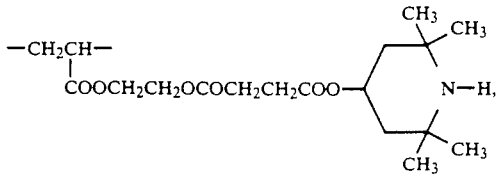

-continued

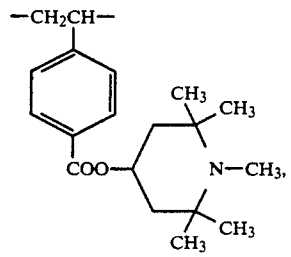

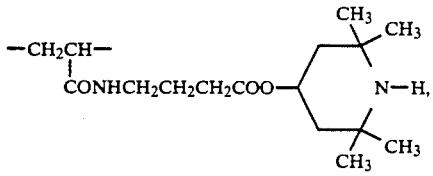

Preferred examples of the repeating units derived from the monomer units represented by the general formula (III) are shown below, but the present invention is not limited thereto.

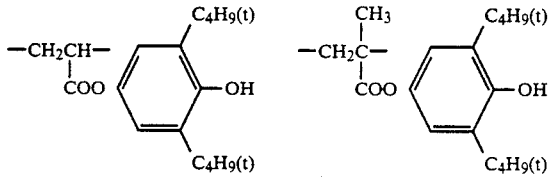

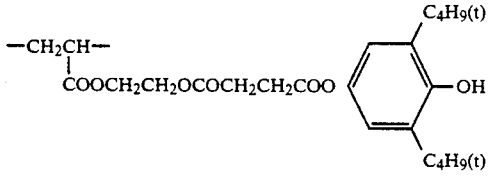

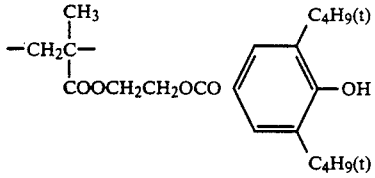

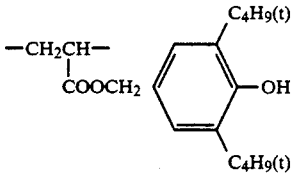

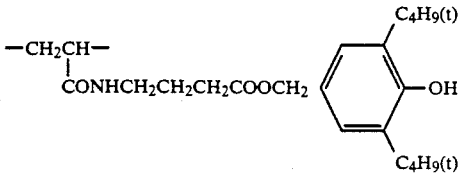

-continued

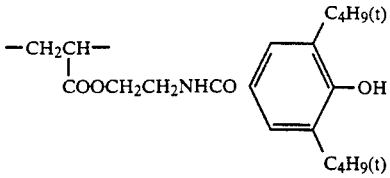

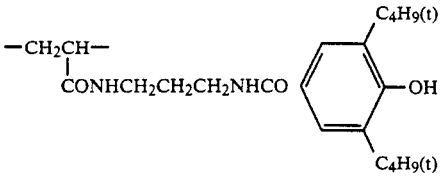

The polymer for use in the present invention may contain repeating units derived from ethylenically unsaturated monomers units other than the monomer units represented by formulae (I) and (II) and the tertiary amino group- or quaternary ammonium salt-containing repeating units represented by formulae (IV) to (VII). the proportion of repeating units derived from such ethylenically unsaturated monomers units in the polymer is in the range of not more than 70%, and is preferably not more than 60%.

Examples of these other ethylenically unsaturated monomers from which repeating units of the polymer of the present invention may be formed include ethylene, propylene, 1-butene, isobutene, styrene, α-methylstyrene, vinyltoluene, monoethylenically unsaturated ester of aliphatic acid (e.g., vinyl acetate, aryl acetate), ethylenically unsaturated monocarboxylic acid (e.g., acrylic acid, methacrylic acid), ethylenically unsaturated dicarboxylic acid (e.g., itaconic acid), esters of the above ethylenically unsaturated monocarboxylic and dicarboxylic acids (e.g., methyl methacrylate, ethyl acrylate, n-butyl acrylate, n-butyl methacrylate, n hexyl methacrylate, n-octyl acrylate, benzyl acrylate, cyclohexyl methacrylate, 2-ethylhexyl acrylate, 2-acetoacetoxyethyl methacrylate), ethylenically unsaturated carboxylic acid or dicarboxylic acid amides (e.g., acrylamide, methacrylamide, acryloylmorpholine, diacetone acrylamide, N-methyl acrylamide), monoethylenically unsaturated compounds (e.g., acrylonitrile, methacrylonitrile, N-vinyl pyrrolidone), diene (e.g., butadiene, isopropylene), and potassium styrenesulfinate.

Alternatively, a monomer containing at least two ethylenically unsaturated groups may be used. Examples of such a monomer include divinyl benzene, ethylene glycol dimethacrylate, isopropylene glycol dimethacrylate, neopentyl glycol dimethacrylate, tetramethylene glycol diacrylate, and tetramethylen glycol dimethacrylate. A monomer containing at least two ethylenically unsaturated groups is preferably incorporated into the polymer, if used, at the time of emulsion polymerization.

Two or more kinds of such ethylenically unsaturated monomers other than the monomers represented by the general formulae (I) and (II) and the monomers containing tertiary amino groups or quaternary ammonium salts, from which the repeating units represented by the general formulae (IV) to (VII) are derived from, may be incorporated into the polymer of the present invention.

Specific preferred nonlimiting examples of polymers for use in the present invention are shown below:

P-1
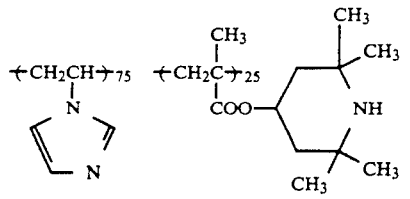
P-2
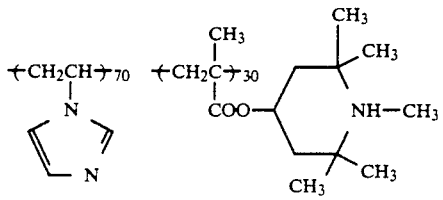
P-3
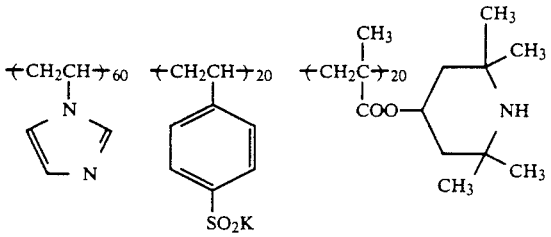
P-4
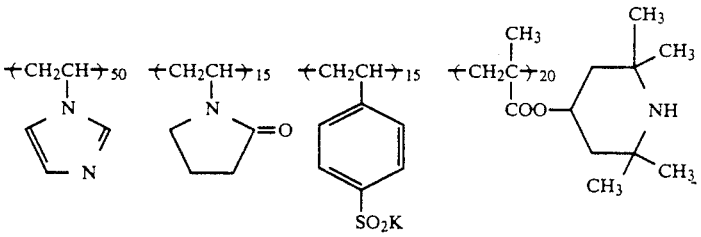
P-5
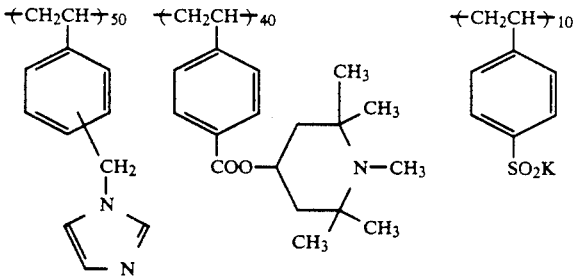
P-6
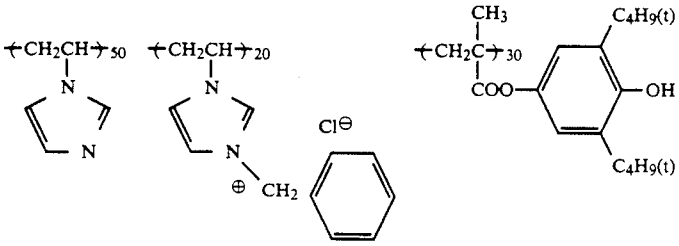

-continued
P-7
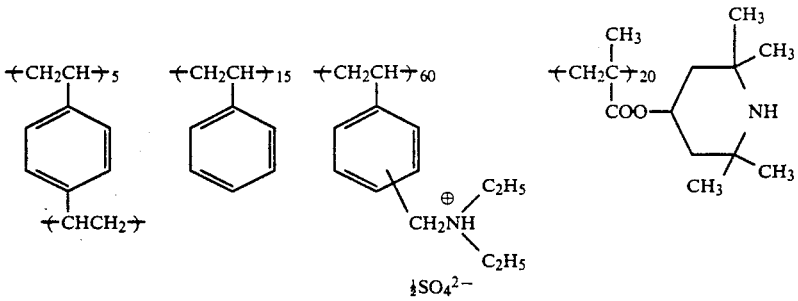
P-8
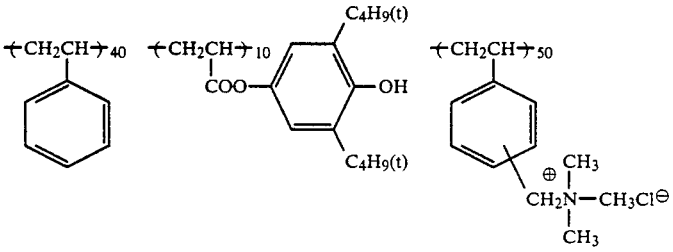
P-9
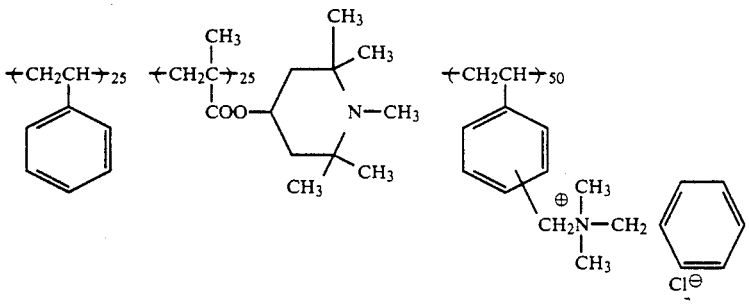
P-10
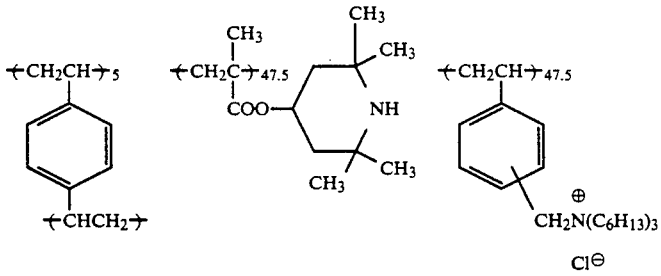
P-11
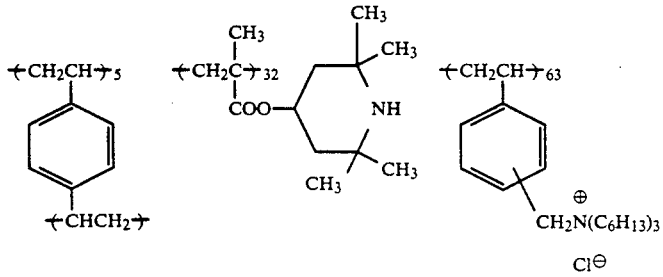

-continued

P-12

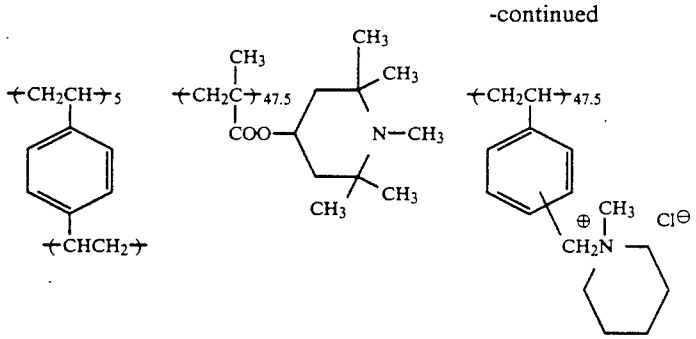

P-13

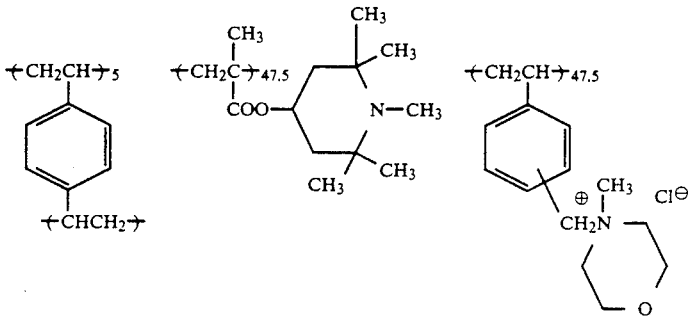

P-14

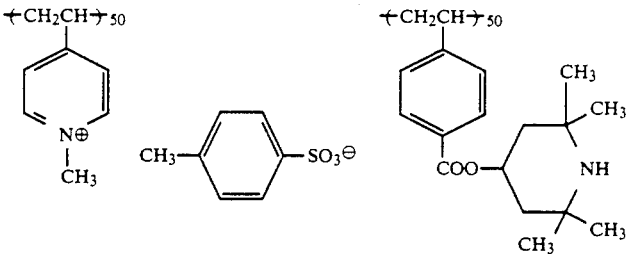

The present invention is further described with reference to the following synthesis examples of polymers for use in the present invention:

SYNTHESIS EXAMPLE 1

Synthesis of poly(N-vinylimidazole-co-2,2,6,6-tetramethyl-4-methacryloyloxypiperidine) (P-1)

7.05 g of 1-vinyl imidazole, 5.20 g of 2,2,6,6-tetramethyl-4-methacryloyloxypiperidine (LA 87, produced by Adeca Agas Inc.), 30 ml of ethanol and 50 ml of distilled water were charged into a 300-ml three-necked flask equipped with a thermometer and a reflux condenser. Nitrogen gas was introduced into the flask to provide a nitrogen blanket over the material. The material was then heated to a temperature of 80° C. When the material reached constant temperature of 0.25 g of 2,2'-azobis(2-amidinopropane)hydrochloride (V-50, produced by Wako Pure Chemical Industries, Ltd.) was added. The material was further heated to a temperature of 80° C with stirring for 1 hour. A mixed solution of 28.7 g of 1-vinylimidazole, 20.8 g of LA-87, 1.00 g of V-50 and 20 ml of distilled water was added dropwise to the material over 1 hour.

After the dropwise addition was completed, the material was further heated to a temperature of 80° C. with stirring for 5 hours. The material was then allowed to cool to room temperature. 250 ml of distilled water was then added to the material. The solution was then dialyzed through a semipermeable membrane against tap water for 48 hours. The material was then lyophilized to obtain 53.1 g of the polymer P-1 with a yield of 86%.

SYNTHESIS EXAMPLE 2

Synthesis of poly(divinylbenzene-co-2,2,6-tetramethyl-4-methacryloyloxypiperidine-co-N,N,N-trihexyl N-vinylbenzylammoniumchloride) (P-10)

1.53 g of

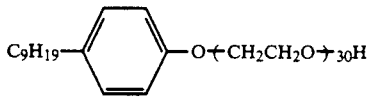

(Emalex NP-30, produced by the Nippon Emulsion Co.), 1.18 g of divinylbenzene, 10.66 g of 2,2,6,6-tetramethyl-4-methacryloyloxypiperidine (LA-87, produced by Adeca Agas Inc.), 20.0 g of N,N,N-trihexyl-N-vinylbenzylammonium chloride, and 320 g of distilled water were charged into a 500-ml three-necked flask equipped with a thermometer and a reflux condenser. Nitrogen gas was introduced into the flask to provide a nitrogen blanket over the material. The material was then heated to a temperature of 70° C. with stirring at 200 rpm.

When the material reached constant temperature,7 ml of an aqueous solution containing 0.27 g of 2,2'-azobis(2-amidinopropane) hydrochloride (V-50) was added to the material. The material was further heated with stirring over 5 hours to obtain a translucent white stable latex dispersion (Yield: 345 g; solid content: 9.50%; grain diameter: 0.36 m).

Other exemplary polymer compounds can be synthesized in the manner similar to that used in Synthesis Examples 1 and 2.

The polymer mordants of the present invention may be used as mordants for a color diffusion transfer process or for heat-developable light-sensitive materials. The polymer mordants of the present invention may also be used as mordant dyes for the antihalation layer of described in U.S. Pat. No. 3,282,699.

The layer comprising the present polymer may consist solely of a film by the polymer. However, the polymer film may optionally contain a natural or synthetic hydrophilic polymer such as gelatin, polyvinyl alcohol or polyvinyl pyrrolidone, and preferably polyvinyl alcohol. Two or more polymer mordants of the present invention (e.g., a combination of a polymer mordant and a polymer dispersion mordant) may be incorporated in one or more layers. Alternatively, a polymer mordant of the present invention may be incorporated into one layer as a mixture with other mordants. Furthermore, a polymer mordant of the present invention and other mordants may be incorporated in separate layers in the same photographic element. The polymer mordant of the present invention may be incorporated into the extra dye catching mordant layer described in U.S. Pat. 3,930,864. Examples of mordants for use in combination with the polymer mordant of the present invention include those described in U.S. Pat. Nos. 4,131,469 and 4,147,548, and JP-A-52-136626, JP-A-54-126027, and JP-A-54-145529.

The amount of the polymer mordant to be used in the photographic element of the present invention is readily determined by those skilled in the art depending on the amount of the dye to be mordanted, the type and composition of the polymer mordant to be used, the image formation process to be employed, etc. Typically the addition amount of the polymer mordant of the present invention is in the range of about 20 to 80% by weight of the mordant layer or about 0.5 to 15 g/m$^2$, and preferably 40 to 60% by weight of the mordant layer or about 1 to 10 g/m$^2$.

In the photographic element of the present invention, known discoloration inhibitors may be used, including oxidation inhibitors, ultraviolet absorbers or certain types of metal complexes. These discoloration inhibitors may be incorporated in the layers wherein the present polymer mordants of the present invention have been provided or in adjacent layers in a form such that the discoloration inhibitors remain therein after the completion of the image formation process.

Examples of the oxidation inhibitors for use in the present invention include chroman compounds, couramane compounds, phenol compounds (e.g., hindered phenols), hydroquinone derivatives, hindered amine derivatives, and spiroindane compounds. In addition, the compounds described in JP-A-61-159644 may be effectively used.

Examples of the ultraviolet absorbers for use as discoloration inhibitors in the present invention include benzotriazole compounds as described in U.S. Pat. No. 3,533,794, 4-thiazolidone compounds as described in U.S. Patent 3,352,681, and the compounds described in JP-A-54-48535, JP-A-62-136641, and JP-A-61-88256. In addition, the ultraviolet absorbing polymers described in JP-A-62-260152 may be effectively used.

Examples of the metal complexes for use as discoloration inhibitors in the present invention include the compounds described in U.S. Pat. Nos. 4,241,155, 4,245,018 (3rd to 36th columns) and 4,254,195 (3rd to 8th columns), JP-A-62-174741, JP-A-61-88256 (pp 27-29), JP-A-1-75568 and JP-A-63-199248.

Useful examples of discoloration inhibitors are also described in JP-A 62-215272 (pp 125-137).

The discoloration inhibitor for inhibiting the discoloration of dyes transferred to the image receiving element may be previously incorporated into the image receiving element or supplied to the image receiving element externally, from, for example, a light-sensitive element.

These oxidation inhibitors, ultraviolet absorbers and metal complexes may be used in combination.

The present invention maybe used in a color diffusion transfer element, as described below.

A typical film unit for use in a color diffusion transfer process includes an image receiving element and a light-sensitive element laminated on a transparent support. In this embodiment, it is unnecessary to peel the light-sensitive element off of the image receiving element after the completion of image transfer. More specifically, the image receiving element consists of at least one mordant layer and a preferred embodiment of the light-sensitive element comprises a combination of a blue-sensitive emulsion layer, a green-sensitive element and a red-sensitive emulsion layer; a combination of a green-sensitive emulsion layer, a red-sensitive emulsion layer and an infrared-sensitive emulsion layer; or a combination of a blue-sensitive emulsion layer, a red-sensitive emulsion layer and an infrared-sensitive emulsion layer, each of the emulsion layers being combined with a yellow dye donating substance, a magenta dye donating substance and a cyan dye donating substance. The term "infrared-sensitive emulsion layer" as used herein means an emulsion layer which is sensitive to light of a wavelength of 700 nm or more, particularly 740 nm or more. A white reflective layer containing a solid pigment such as titanium oxide is interposed between the mordant layer and the light-sensitive layer or the dye donating substance-containing layer such that the transferred images can be observed through the transparent support.

A light shielding layer may be provided interposed between the white reflective layer and the light-sensitive layer such that development can be completed in the daylight. A release layer may be provided in a proper position such that the light-sensitive element can be partially or entirely peeled off the image-receiving layer as required as described in JP-A-56-67840 and Canadian Patent 674,082.

Another embodiment of the laminated type strippable film unit is a color diffusion transfer photographic film unit as described in JP-A-63-226649 comprising a light-sensitive element sequentially having at least one silver halide emulsion layer combined with at least (a) a layer having a neutralizing function, (b) a dye image receiving layer, (c) a release layer, and (d) a dye image-forming substance, in addition to an alkali processing composition containing a light screen, and a transparent cover sheet on a white support, wherein a layer having a light screening function is provided on the site of the support opposite to that over which the processing composition is spread over the emulsion layer.

In an embodiment requiring no peel, a light-sensitive element as described above is provided on a transparent support. A white reflective layer is provided on the light-sensitive layer. An image receiving layer is laminated on the white reflective layer.

An embodiment wherein an image receiving element, a white reflective layer, a release layer and a light-sensitive element are laminated on the same support such that the light-sensitive element can be intentionally peeled from the image receiving element is described in U.S. Pat. No. 3,730,718.

On the other hand, typical film units wherein a light-sensitive element and an image receiving element are separately coated on two supports are, classified into two major types. The first is a release type, and the other is a releaseless type. Specifically, a preferred embodiment of the release type film unit comprises at least one image receiving layer coated on a support, and a light-sensitive element coated on another support having a light screen layer, wherein the light-sensitive layer-coated surface and the mordant layer-coated surface are not opposed to each other before the completion of exposure, but the light-sensitive layer-coated surface is overturned and superimposed on the image receiving layer-coated surface after the completion of exposure (e.g., during development). After the formation of the transferred images on the mordant layer, the light-sensitive element is readily peeled from the image receiving element.

A preferred embodiment of the releaseless type film unit comprised at least one mordant layer is coated on a transparent support, and a light-sensitive element coated on another transparent support or a support having a light screen layer, wherein a light-sensitive layer-coated surface and a mordant layer-coated surface are superimposed opposed to each other.

These embodiments of film units may further be combined with pressure-rupturable vessels containing an alkaline processing solution (processing element). In a releaseless type film unit wherein an image receiving element and a light-sensitive element are laminated on a support, such a processing element is preferably interposed between the light-sensitive element and a cover sheet superimposed thereon. In a form wherein a light-sensitive element and an image receiving element are separately coated on two supports, the processing element is preferably provided between the light-sensitive element and the image receiving element during development. The processing element preferably contains a light screen (e.g., carbon black, or a dye which changes color depending on pH) and/or a white pigment (e.g., titanium oxide). In a film unit for a color diffusion transfer process, a neutralization timing mechanism comprising a combination of a neutralizing layer and a neutralization timing layer may be preferably incorporated in a cover sheet, an image receiving element or a light-sensitive element. When the present invention is applied to a light-sensitive element for color diffusion transfer process, a useful dye-forming substance includes a nondiffusive compound which releases a diffusive dye or dye precursor or a compound, the diffusivity of which changes upon the development of silver. These compounds are described in *The Theory of the Photographic Process*, th ed., edited by T.H. James. These compounds can be represented by formula (VIII):

DYE—Y (VIII)

wherein DYE represents a dye or a dye precursor; and Y represents a group which provides a compound having a different diffusivity from that of the compound of formula (VIII) under an alkaline condition. By the action of Y, the compound of formula (VIII) is roughly divided into a negative-working compound which becomes diffusive in the developed silver portion or a positive-working compound which becomes diffusive in the undeveloped silver portion.

Examples of a negative working dye releasing group represented by Y include a compound which undergoes oxidation and cleavage upon development to release a diffusive dye.

Specific examples of groups represented by Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, and JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, and JP-A-57-119345.

A particularly preferred group repreented by Y in a negative-working dye-releasing redox compound is a N-substituted sulfamoyl group. Examples of the N-substituting group include aromatic groups derived from an aromatic hydrocarbon ring or heterocyclic ring. Specific examples of groups repreented by Y are shown below, but the present invention is not to be construed as being limited thereto.

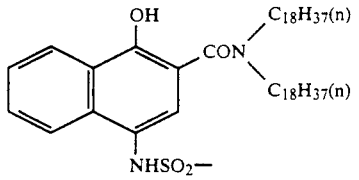

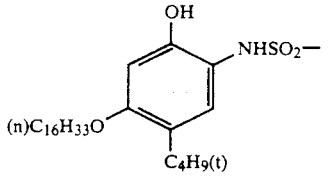

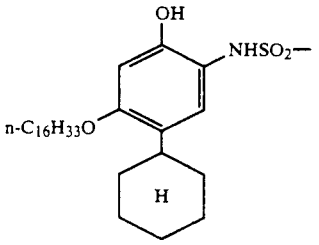

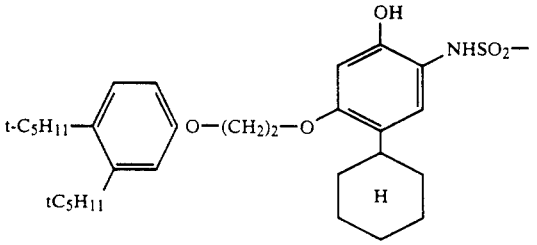

-continued

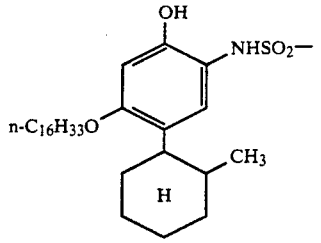

Positive type compounds are described in *Angew. Chem. Inst. Ed. Engl.*, 22, 191 (1982).

Specific examples of such positive-working compounds include a compound which is initially diffusive under an alkaline condition but becomes nondiffusive when oxidized upon development by a dye developing agent. Typical examples of Y effective for this type of compound are described in U.S. Pat. No. 2,983,606.

Another useful dye forming substance is a compound which undergoes ring closure or a similar reaction, to release a diffusive dye under an alkaline condition, but substantially suspends release of the dye when oxidized upon development. Specific examples of Y having such a function are described in U.S. Pat. Nos. 3,980,479, 3,421,964, and 4,199,355, and JP-A-53-69033, and JP-A-54-130927.

Another useful dye forming substance is a compound which doesn't release a dye itself, but acts to release a dye when reduced. This type of compound is used in combination with an electron donor; and reacts with the electron donor which has been left unoxidized after imagewise oxidation upon silver development to release a diffusive dye. Examples of atomic groups Y which provide a dye forming substance with such a function are described in U.S. Pat. Nos. 4,183,753, 4,142,891, 4,278,750, 4,139,379, 4,218,368, 4,278,750, 4,356,249, and 4,358,525, JP-A-53-110827, JP-A 53-110827, JP-A-54-130927, and JP-A-56-164342, Kogai Giho 87-6199, and European Patent 220746A2.

Specific examples of such atomic groups are shown below, but the present invention is not be construed as being limited thereto.

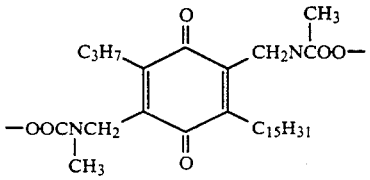

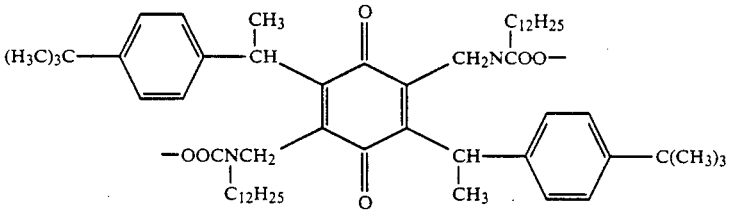

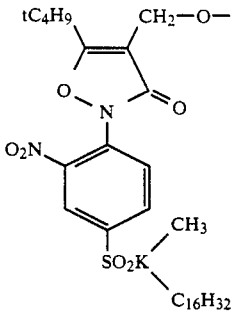

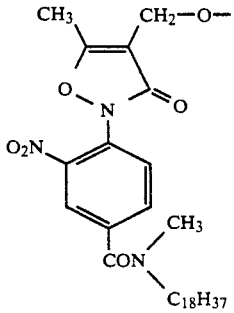

This type of dye releasing substance is preferably used in combination with a nondiffusive electron donating compound (known as an ED compound) or a precursor thereof. Examples of such an ED compound are described in U.S. Pat. Nos. 4,263,393 and 4,278,750, and JP-A-56-138736.

Specific examples of another type of dye-forming substance for use in the present invention is shown below:

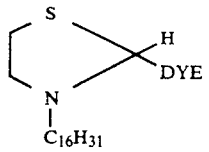

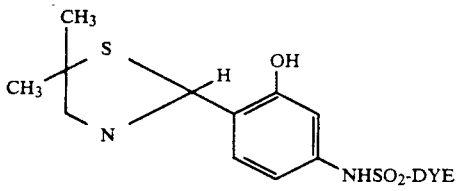

wherein DYE represents a dye as defined above or a precursor thereof.

The details of this type of compound are described in U.S. Pat. Nos. 3,719,489, and 4,098,783.

On the other hand, specific examples of dyes represented by the general formula DYE are described in the following references.

Examples of Yellow Dyes

U.S. Pats. Nos. 3,597,200, 3,309,199, 4,013,633, 4,245,028, 4,156,609, 4,139,383, 4,195,992, 4,148,641, 4,148,643, and 4,336,322, JP-A 51-114930, and JP-A-56-72, Research Disclosure Nos. 17630 (1978), and 16475 (1977).

Examples of Maqenta Dyes

U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and JP-A-52-106727, JP-A-53-23628, JP-A-55-36804, JP-A-56-73057, JP-A-56-71060, and JP-A-55-134.

Examples of Cyan Dyes

U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, and JP-A-56-71061, European Patent (EPC) 53,037, and 53,040, and Research Disclosure Nos. 17630 (1978), and 16475 (1977).

In the present invention, the silver halide emulsion for use in a color diffusion transfer process may be a negative type emulsion, wherein latent images are formed on the surface of the silver halide grains; or an internal latent image type direct positive emulsion, wherein latent images are formed inside the silver halide grains.

Examples of such an internal latent image type direct positive emulsion include a so called "conversion type" emulsion prepared by substituting the silver halide of the emulsion grains with a silver halide of differing solubility, and "core/shell type" emulsion wherein the light-sensitive sites present in the core of the silver halide grains have been doped with metal ions or chemically sensitized are covered with an external shell. Examples of such emulsions are described in U.S. Pat. Nos. 2,592,250, 3,206,313, 3,761,276, 3,935,014, 3,447,927, 2,497,875, 2,563,785, 3,551,662, 4,395,478, and 4,431,730, British Patent 1,027,146, and West German Patent 2,728,108.

If such an internal latent image type direct positive emulsion is used, the surface thereof must necessarily be provided with fogged nuclei by the use of light or a nucleating agent after imagewise exposure.

Examples of nucleating agents for use in the present invention include hydrazines as described in U.S. Pat. Nos. 2,563,785, and 2,588,982, hydrazides and hydrazines as described in U.S. Pat. No. 3,227,552, heterocyclic quaternary salt compounds as described in British Patent 1,283,835, JP-A-52-69613, and U.S. Pat. Nos. 3,615,615, 3,719,494, 3,734,738, 4,094,683, and 4,115,122, sensitizing dyes containing in dye molecules substituents having a nucleating effect as described in U.S. Pat. No. 3,718,470, thiourea bond type acrylhydrazine compounds as described in U.S. Pat. Nos. 4,030,925, 4,031,127, 4,245,037, 4,255,511, 4,266,013, and 4,276,364, and British Patent 2,012,443, and acylhydrazine compounds bonded with a heterocyclic group, e.g., thioamide ring, triazole or tetrazole as an adsorbing group, as described in U.S. Pat. Nos. 4,080,270, and 4,278,748, and British Patent 2,011,391B.

In the present invention, these negative emulsions or internal latent image type direct positive emulsions may be used in combination with a spectral sensitizing dye. Specific examples of spectral sensitizing dyes for use in the present invention are described in JP-A-59-180550, and JP-A-60-140335, Research Disclosure No. 17029, and U.S. Pat. Nos. 1,846,300, 2,078,233, 2,089,129, 2,165,338, 2,231,658, 2,688,545, 2,921,067, 3,282,933, 3,397,060, 3,660,103, 3,335,010, 3,352,680, 3,384,486, 3,623,881, 3,718,470, and 4,025,349.

For the reproduction of natural colors by a subtractive color process, a light sensitive layer comprising at least two combinations of an emulsion spectrally sensitized with the above described spectral sensitizing dyes, and the above described dye-forming substance which provides a dye having a selective spectral absorption in the same wavelength range, is used. The emulsion and the dye-forming substance may be separately coated as separate layers or coated in admixture in a single layer. If the dye-forming substance has an absorption in the spectral sensitivity range of the emulsion combined therewith, the two components are preferably coated as separate layers. The emulsion layer may comprise a plurality of emulsion layers having different sensitivities. Furthermore, an intermediate layer may be provided between the emulsion layer and the dye-forming substance layer. For example, a layer containing a nucleation development accelerator as described in JP-A-60-173541 or a partition layer as described in JP-B-60 15267 (the term "JP-B" as used herein means an "examined Japanese patent publication") may provided to increase the color image density. Alternatively, a reflective layer as described in JP-A-60-91354 may be provided to increase the sensitivity of the light-sensitive element.

In a preferred multilayer structure, a unit of combined blue-sensitive emulsions, a unit of combined green-sensitive emulsions, and a unit of combined red-sensitive emulsions are essentially provided in order from the exposure side.

An intermediate layer may be optionally provided between the above-described emulsion layer units. If a compound which releases a diffusive dye by the action of silver ions is used, as described in JP-B-55-7576, a compound which supplies silver ions is preferably incorporated into the intermediate layer.

In the present invention, an anti irradiation layer, a partition layer, a protective layer or the like may be provided as necessary.

The processing solution for use in processing the photographic element of the present invention is uniformly spread over a light-sensitive element after exposure so as to completely shielding the light-sensitive layer from external light in combination with a light shielding layer provided on the back side of the support or on the side of the light-sensitive layer opposite to the processing solution, and to simultaneously develop the light-sensitive layer. Therefore, the processing composition comprises an alkali, a thickening agent, a light shielding agent, and a developing agent. The processing composition further comprises a development accelerator or inhibitor for adjusting development, and an oxidation inhibitor for inhibiting the deterioration of the developing agent.

Any alkali may be used in the processing composition as long as it adjusts the pH value thereof to from 12 to 14. Examples of such an alkali include the hydroxides of alkaline metals (e.g., sodium hydroxide, potassium hydroxide, lithium hydroxide), phosphates of alkaline metals (e.g., potassium phosphate), guanidines, and hydroxides of quaternary amines (e.g., tetramethylammonium hydroxide). Preferred among these alkalines are potassium hydroxide, and sodium hydroxide.

A thickening agent is used to uniformly spread the processing solution or keep the light-sensitive layer and the cover sheet in close contact with each other when the light-sensitive layer is peeled together with the cover sheet. For example, alkaline metal salts of polyvinyl alcohol, hydroxyethyl cellulose or carboxymethyl cellulose are used as the thickening The light shielding atent may include any dye, or pigment, or a combination thereof, as long as it is not diffusive or develops stains in the dye image-receiving layer. Typical examples of such a light shielding atent include carbon black. Other examples of a light shielding atent which can be used in the present invention include a combination of titanium white and a dye. The dye may be a temporary light screen dye which becomes colorless at a predetermined time after processing.

Any developing agent may be used as long as it makes cross oxidation of a dye forming substance and does not develop stains when oxidized. Such developing agents may be used singly or in combination. Such developing agents may be used in the form of precursor. These developing agents may be incorporated in a suitable layer in the light-sensitive element, or in the alkaline processing solution. Specific examples of such developing agents include aminophenols and pyrazolidones. Among these compounds, pyrazolidones are particularly preferred because they develop little stain. developing agent include 1-phenyl-3-pyrazolidinone, 1-p-tolyl-4,4-dihydroxymethyl-3-pyrazolidinone, 1-(3'-methyl-phenyl)-4-methyl-4-hydroxy 3-pyrazolidinone, 1-phenyl-4-methyl-4-hydroxymethyl-3-pyrazolidinone, and 1-p-tolyl-4-methyl-4-hydroxymethyl-3-pyrazolidinone.

In the film unit for color diffusion transfer process of the present invention, a neutralizing function is preferably provided between the support and the light-sensitive layer, or between the support and the image receiving layer, or on the cover sheet.

The neutralizing layer comprises an acidic substance in an amount large enough to neutralize an alkali brought from the processing solution. The neutralizing layer optionally has a multilayer structure consisting of a neutralization rate adjusting layer (a timing layer), a contact promoting layer, etc. Preferred acidic substance contain an acidic group with a pKa of 9 or less (or a precursor group which undergoes hydrolysis to provide such an acidic group). Preferred examples of acidic substances for use in the neutralization layer include higher aliphatic acids such as oleic acid as described in U.S. Pat. No. 2,983,606, polymers of acrylic acid, methacrylic acid or maleic acid and partial ester or acid anhydride thereof as disclosed in U.S. Pat. No. 3,362,819, copolymers of acrylic acid and acrylic ester as disclosed in French Patent 2,290,699, and latex type acidic polymers as disclosed in U.S. Pat. No. 4,139,383, and Research Disclosure No. 16102 (1977).

Other examples of acidic substances for use in the neutralizing layer of the present invention include those described in U.S. Pat. No. 4,088,493, and JP-A-52-153739, JP-A-53 1023, JP-A-53-4540, JP-A-53-4541, and JP-A-53-4542.

Specific examples of acidic polymers for use in the neutralizing layer of the present invention include copolymers of vinyl monomers such as ethylene, vinyl acetate or vinyl methyl ether with maleic anhydride, copolymers thereof with n-butyl ester, butyl acrylate or acrylic acid, and cellulose acetate hydrodiene phthalate.

The above described polymeric acid may be used in admixture with a hydrophilic polymer, examples of which include polyacrylamide, polymethyl pyrrolidone, polyvinyl alcohol (including partially saponified compound), carboxymethyl cellulose, hydroxymethyl cellulose, hydroxyethyl cellulose, and polymethyl vinyl ether. Particularly preferred among these compounds is polyvinyl alcohol.

The amount of the polymeric acid to be added to the neutralizing layer is adjusted depending on the amount of alkaline to be spread over the light-sensitive element. The equivalent ratio of the polymeric acid to alkali per unit area is preferably in the range of from 0.9 to 2.0, and particularly from 1.0 to 1.3. If the polymeric acid is used in too small an amount, the color hue of the transferred dyes tends to change, or the white background develops stain. If the polymeric acid is used in too large an amount, the color hue of transferred dyes also tends to change, or the light resistance of the light sensitive material deteriorates. If the amount of the hydrophilic polymer to be used in admixture with the polymeric acid is too large or small, the photographic quality deteriorates. The weight ratio of the hydrophilic polymer to the polymeric acid is in the range of 0.1 to 10, preferably 0.3 to 3.0.

Other appropriate additives may be incorporated into the present neutralizing layer for various purposes. For example, a known film hardener may be incorporated in the neutralizing layer for the purpose of hardening the layer. A polyvalent hydroxyl compound such as polyethylene glycol, polypropylene glycol or glycerin may be incorporated in the neutralizing layer for the purpose of eliminating brittleness of the film. Furthermore, an oxidation inhibitor, a fluorescent brightening agent, a bluing dye, or the like may be incorporated into the neutralizing layer as necessary.

Material for use in the timing layer in combination with the neutralizing layer includes a polymer which lowers alkali permeability such as gelatin, polyvinyl alcohol, partially acetalized polyvinyl alcohol, cellulose acetate, and partially hydrolyzed polyvinyl acetate; a latex polymer prepared by the copolymerization therein of a small amount of a hydrophilic comonomer such as acrylic monomer, which raises the activation energy of alkali permeation, and a polymer containing lactone rings, or the like.

Particularly useful examples of such polymers include timing layers comprising cellulose acetate as disclosed in JP-A-54-136328, and U.S. Pat. Nos. 4,267,262, 4,009,030, and 4,029,849, latex polymers prepared by the copolymerization therein of a small amount of a hydrophilic comonomer such as acrylic acid as disclosed in JP-A-54-128335, and JP-A-56-69629, and U.S. Pat. Nos. 4,056,394, 4,061,496, 4,199,362, 4,250,243, 4,256,827, and 4,268,604 and polymers containing lactone rings as disclosed in U.S. Pat. No. 4,229,516, and polymers as disclosed in JP-A-56-25735, JP-A-56-97346, and JP-A-57- 6842, and European Patents (EP) 31957A1, 37724A1, and 48412A1.

In addition, polymers for use in the timing layer include those described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, West German Patent Applications (OLS) 1,622,936, and 2,162,277, and Research Disclosure 15162 No.151 (1976).

The timing layer may comprise a single layer or a combination of two or more layers.

The timing layer comprising the above described elements may contain a development inhibitor and/or a precursor thereof as disclosed in U.S. Pat. No. 4,009,029, West German Patent Applications (OLS) 2,913,164, and 3,014,672, and JP-A =54-155837, and JP-A-55-138745, a hydroquinone precursor as disclosed in U.S. Pat. No. 4,201,578, or other photographically useful additives or precursors thereof.

Another useful embodiment of the present invention is a heat-developable light-sensitive element. A heat-developable light-sensitive element essentially comprises a light sensitive silver halide and a binder provided on a support. The heat-developable light-sensitive element may further optionally comprise an organic metal salt oxidizing agent, a dye donating compound (a reducer may concurrently serves as a dye donating compound as described below), or the like. These components are mostly incorporated in the same layer. If these components are reactive with each other, they may be incorporated into separate layers. For example, a colored dye-donating compound can be present in the layer under the silver halide emulsion to prevent a reduction in the sensitivity. The reducer is preferably incorporated in the heat-developable light-sensitive element. The reducer may be externally supplied, e.g., by diffusion from a dye-fixing element as described below.

In order to obtain a wide range of colors in the chromaticity diagram from three primaries, i.e., yellow, magenta and cyan, at least three silver halide emulsion layers having light sensitivity in different spectral regions may be used in combination. For example, a combination of a blue-sensitive layer, a green sensitive layer and a red sensitive layer, or a combination of a green-sensitive layer, a red-sensitive layer and an infrared-sensitive layer or the like may be used. These light-sensitive layers may be arranged in various orders typical to color light-sensitive materials. The light-sensitive layers may optionally comprise two or more layers.

The heat-developable light-sensitive element may comprise various auxiliary layers such as a protective layer, subbing layer, intermediate layer, yellow filter layer, antihalation layer or backing layer.

Silver halides including silver chloride, silver bromide, silver bromoiodide, silver bromochloride, and silver bromochloroiodide can be used in a heat developable light-sensitive element of the present invention.

The silver halide emulsion for use in the present heat-developable light-sensitive element may be either a surface latent image type or internal latent image type emulsion The internal latent image type emulsion may be used as a direct reversal emulsion in combination with a nucleating agent or light fogging agent. The silver halide emulsion for use in a heat developable light-sensitive element of the present invention may be a core/shell emulsion wherein the inner portion and the outer portion thereof are different in phase. The silver halide emulsion for use in the present invention may be monodisperse or polydisperse. The silver halide emulsion may be used in admixture with a monodisperse emulsion. The size of silver halide grains to be contained in the present silver halide emulsion is preferably in the range of from 0.1 to 2 μm, and particularly from 0.2 to 1 5 μm. The crystal structure of the silver halide grains may comprise a cube, octahedron, tetradecahedron, or tablet having a high aspect ratio, etc.

In particular, the silver halide emulsions described in U.S. Pat. Nos. 4,500,626, and 4,628,021, Research Disclosure No. 17029 (1978), and JP-A-62-253159 can be used in a heat developable light-sensitive element of the present invention.

The present silver halide emulsion may be used without ripening, but the emulsion is normally subjected to chemical sensitization before use. When applied to ordinary type light sensitive elements, the present silver halide emulsion may be subjected to sulfur sensitization, reduction sensitization, noble metal sensitization, etc., singly or in combination. These chemical sensitization processes may be effected in the presence of a nitrogen-containing heterocyclic compound as described in JP-A-62-253159.

The coated amount of the light-sensitive silver halide for use in the heat-developable light-sensitive element of the present invention is in the range of 1 mg to 10 $g/m^2$, calculated as silver.

The silver halide may be spectrally sensitized with a methine dye or the like, examples of which include cyanine dyes, melocyanine dyes, composite cyanine dyes, composite melocyanine dyes, holopolar cyanine dyes, hemicyanine dyes, styryl dyes, and hemioxonol dyes.

Specific examples of such dyes include sensitizing dyes as described in U.S. Pat. No. 4,617,257, JP-A 59-180550, and JP-A-60-140335, and *Research Disclosure* No. 17029 (1978) (pp 12-13).

The above described sensitizing dyes may be used, singly or in combination thereof A combination of sensitizing dyes is often used for the purpose of supersensitization.

The present silver halide emulsion may comprise a dye which doesn't exhibit a spectral sensitizing effect, or a compound which does not substantially absorb visible light but exhibits a supersensitizing effect (e.g., dyes or compounds as described in U.S. Patent 3,615,641, and JP-A-63-23145.

The incorporation of these sensitizing dyes into the present silver halide emulsion may be effected during, before, or after chemical ripening. Alternatively, the incorporation of these sensitizing dyes into the present silver halide emulsion may be effected before or after the nucleation of the silver halide grains as disclosed in U.S. Pat. Nos. 4,183,756, and 4,225,666. The amount of these sensitizing dyes for incorporation into the present silver halide emulsion is normally in the range of from $10^{-8}$ to $10^{-2}$ mol per mol of silver halide.

In the heat-developable light-sensitive element of the present invention, an organic metallic salt may be used as an oxidizing agent together with the light-sensitive silver halide An organic silver salt is preferably used.

Examples of organic compounds which can be used to form the above described organic silver salt oxidizing agent include benzotriazoles as described in U.S. Pat. No. 4,500,626 (52nd to 53rd columns), aliphatic acids and other compounds. Other useful examples of such organic compounds include silver salts of carboxylic acids containing alkinyl groups such as silver phenylpropionate as described in JP-A-60-113235, and acetylene silver as described in JP-A-61-249044. These organic silver salts may be used in combination thereof.

The above described organic silver salts are used in an amount of from 0.01 to 10 mol, and preferably 0.01 to 1 mol per mol of the light sensitive silver halide. The total amount of the light-sensitive silver halide and the organic silver salt to be coated is preferably in the range of from 50 mg to 10 g/m$^2$ as calculated as silver The present heat-developable light-sensitive element may comprise various fog inhibitors or photographic stabilizers Examples of such fog inhibitors or photographic stabilizers include azoles or azaindenes as described in *Research Disclosure* No. 17643 (1978) pp. 24-25, nitrogen-containing carboxylic acids and phosphoric acids as described in JP-A-59-168442, mercapto compounds and metallic salts thereof as described in JP-A-59-111636, and acetylene compounds as described in JP-A-62-87957.

The binder constituting the layers of the heat-developable light-sensitive element or dye-fixing element of the present invention is preferably a hydrophilic compound, examples of which include the compounds described in JP-A-62-253159, pp. 26-28. In particular, a transparent or semitransparent hydrophilic binder is preferably used. Specific examples of such a transparent or semitransparent hydrophilic binder include natural compounds such as protein (e.g., gelatin, gelatin derivatives) or polysaccharides (e.g., cellulose derivatives, starch, gum arabic, dextran, pullulan), and synthetic high molecular compounds such as polyvinyl alcohol, polyvinylpyrrolidone and acrylamide polymer Other examples of binders for use in the photographic element of the present invention include high water-absorbing polymers as described in JP-A-62-245260, i.e., a homo polymer of vinyl monomers containing —COOM or S03M (wherein M represents hydrogen or an alkaline metal) or copolymers of the vinyl monomers or copolymers of the vinyl monomers with other vinyl monomers (e.g., sodium methacrylate, ammonium methacrylate, Sumicagel L-5H (Sumitomo Chemical Co., Ltd.)). These binders may be used in combination thereof.

If a system employing a slight amount of water to effect heat development, the above described high water-absorbing polymer may be used to enable rapid water absorption. If such a high water-absorbing polymer is incorporated into a dye fixing layer or its protective layer, the dyes can be prevented from being re-transferred from the dye-fixing element to other elements after transfer.

In the photographic element of the present invention, the coated amount of the binder is preferably in the range of 20 g or less, particularly 10 g or less, more particularly 7 g or less per m$^2$ of the photographic element.

The constituent layers of the heat-developable light-sensitive element or dye-fixing element (including backing layer) may comprise various polymer latexes for stabilizing dimension and inhibiting curling, adhesion, film cracking and pressure sensitization or desensitization. Specifically, any of polymer latexes described in JP-A-62-245258, JP-A-62-136648, and JP-A-62-110066 can be used. In particular, a polymer latex having as low a glass transition point of 40° C. or less can be incorporated into the mordant layer to prevent cracking thereof. On the other hand, a polymer latex having a high glass transition point can be incorporated in a backing layer to obtain a curling inhibition effect.

Known reducers can be incorporated into the heat-developable light-sensitive element of the present invention, examples of which include dye-donating compounds having a reducing function as described below. Such dye-donating compounds may also be used in combination with other reducing agents. Alternatively, a reducer precursor which does not exhibit a reducing function itself, but exhibits a reducing effect by the action thereon of a nucleophilic reagent or heat during development can be used in the present invention.

Examples of reducers which can be incorporated into the heat-developable light-sensitive element of the present invention include reducers or reducer precursors as described in U.S. Pat. Nos. 4,500,626 (49th to 50th columns), 4,483,914 (30th to 31st columns), 4,330,617, and 4,590,152, JP-A-60-140335 (pp. 17-18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A 60-181742, JP-A-61-259253, JP-A-62-244044, JP-A-62-131253, and JP-A-62-131256, and European Patent 220,746A2 (pp. 78-96).

A combination of reducers as disclosed in U.S. Pat. No. 3,039,869 can be used in the present invention.

If a nondiffusive reducer is used, it may be optionally used in combination with an electron transfer agent and/or precursor thereof in order to accelerate the transfer of electrons between the nondiffusive reducer and a developable silver halide.

The above described electron transfer agent or a precursor thereof may be selected from the above described reducers or precursors thereof. These electron transfer agents or precursors thereof preferably have a greater mobility than the above described nondiffusive reducers (electron donors). Particularly useful among these electron transfer agents are 1-phenyl-3-pyrazolidones or aminophenols.

The nondiffusive reducers (electron donors) for use in combination with electron transfer agents include the above described reducers which do not substantially diffuse in the layers of the light-sensitive element Preferred examples of nondiffusive reducers include hydroquinones, sulfonamidephenols, sulfonamidenaphthols, compounds described as electron donors in JP-A-53-110827, and the nondiffusive reducing dye-donating compounds described below.

In the present invention, the amount of the reducer to be incorporated therein is preferably in the range of from 0.01 to 20 mol, and particularly from 0.1 to 10 mol per mol of silver Examples of dye-donating compounds for incorporation into the heat-developable light-sensitive element of the present invention include a compound which undergoes an oxidation coupling reaction to form a dye (coupler). This coupler may be either a two-equivalent or four-equivalent coupler. A two-equivalent coupler containing a nondiffusive elimination group which undergoes an oxidation coupling reaction to form a nondiffusive dye is preferably used. This nondiffusive group may form a polymer chain. Specific examples of color developing agents and couplers are further described in T. H. James, *The Theory of the Photographic Process*, pp. 291-334 and pp. 354-361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Another example of a dye-donating compound is a compound capable of imagewise releasing or diffusing a diffusive dye. This type of a compound can be represented by formula (LI):

$$(\text{Dye}—\text{Y})_n—\text{Z} \qquad \text{(LI)}$$

wherein Dye represents a dye group having absorption characteristics which have temporarily been shifted to a shorter wavelength or a precursor thereof; Y represents a chemical bond or a connecting group; Z represents a group which provides a difference in the diffusibility of the compounds represented by formula (LI) corresponding to or counter-corresponding to the imagewise distribution of light-sensitive silver salts having a latent image or which releases Dye such that the diffusbility of Dye thus released differs from that of the compound of (Dye-Y)n-Z; and n represents an integer 1 or 2. When n is 2, the two (Dye-Y) groups may be the same or different.

Specific examples of the dye-donating compound represented by formula (LI) include the following compounds (i) to (v). The compounds (i) to (iii) imagewise form a diffusive dye (positive dye image) in portions where the silver halide has not been developed. The compounds (iv) and (v) imagewise form a diffusive dye (negative dye image) corresponding to the development of silver halide (i) Dye developing agents of this type comprise a hydroquinone developing agent connected to a dye component as described in U.S. Pat. Nos. 3,134,764, 3,362,819, 3,597,200, 3,544,545, and 3,482,972. This type of a dye developing agent is diffusive under alkaline conditions, but is rendered nondiffusive upon reaction with silver halide (ii) As described in U.S. Pat. No. 4,503,137, a nondiffusive compound which releases a diffusive dye under alkaline conditions, but loses its function upon reaction with silver halide may be used. Examples of such a nondiffusive compound include compounds which undergo an intramolecular nucleophilic substitution reaction to release a diffusive dye as described in U.S. Pat. No. 3,980,479, and compounds which undergo an intramolecular rewinding reaction of the isooxazolone ring to release a diffusive dye as described in U.S. Pat. No. 4,199,354.

(iii) As described in U.S. Pat. No. 4,559,290, European Patent 220,746A2 and Kokai Giho 87-6199, a nondiffusive compound which reacts with a reducer which has been left unoxidized upon development to release a diffusive dye, may also be used.

Examples of such nondiffusive compounds include compounds which undergo an intramolecular substitution reaction after being reduced to release a diffusive dye as described in U.S. Pat. Nos. 4,139,389, and 4,139,379, and JP-A-59-185333, and JP-A-57-84453; compounds which undergo an intramolecular electron transfer reaction after being reduced to release a diffusive dye as described in U.S. Pat. No. 4,232,107, JP-A-59-101649, and JP-A 61-88257; and *Research Disclosure* No. 24025 (1984); compounds which undergo cleavage of a single bond after being reduced to release a diffusive dye as described in West German Patent 3,008,588, JP-A-56-142530, and U.S. Pat. Nos. 4,343,893, and 4,619,884; nitro compounds which release a diffusive dye after receiving electrons as described in U.S. Pat. No. 4,450,223; and compounds which release a diffusive dye after receiving electrons as described in U.S. Pat. No. 4,609,610.

Further preferred examples of such nondiffusive compounds include compounds containing an N-X bond, wherein X represents oxygen, sulfur or nitrogen and an electrophilic group in one molecule as described in European Patent 220,746A2, Kokai Giho 87-6199, and Japanese Patent Application Nos. 62-34953 and 62-34954; compounds containing an $SO_2$—X bond, wherein X is as defined above and an electrophilic group in one molecule as described in Japanese Patent Application No. 62-106885; compounds containing a PO-X bond, wherein X is as defined above and electrophilic groups per one molecule as described in Japanese Patent Application No. 62-106895; and compounds containing a C—X′ bond, wherein X′ is X as defined above, or represents —$SO_2$and an electrophilic group in one molecule as described in Japanese Patent Application No. 62-106887.

Particularly preferred among these compounds are compounds containing an N-X bond and an electrophilic group in one molecule Specific examples of such compounds include compounds (1) to (3), (7) to (10), (12), (13), (15), (23) to (26), (31), (32), (35), (36), (40), (41), (44), (53) to (59), (64), and (70) described in European Patent No. 220,746A2, and compounds (11) to (23) described in Kokai Giho 87-6199.

(iv) Compounds containing a diffusive dye in the elimination group which undergo reaction with an oxidation product of a reducer to release a diffusive dye (DDR coupler) may be used. Specific examples of such DDR couplers include those described in British Patent 1,330,524, JP-B-48 39165, and U.S. Pat. Nos. 3,443,940, 4,474,867, and 4,483,914.

(v) Compounds capable of reducing silver halide or organic silver salts to release a diffusive dye (DRR compound) may be used. This type of compound doesn't require the combined use of other reducers Therefore, if this type of a compound is used, the staining of images with the oxidation products of a reducer can be eliminated. Typical examples of such a DDR compound are described in U.S. Pat. Nos. 3,928,312, 4,053,312, 4,055,428, 4,336,322, 3,725,062, 3,728,113, 3,443,939, and 4,500,626, JP-A-59-65839, JP-A-59-69839, JP-A-53-3819, JP-A-51-104343, JP-A-58-116537, and JP A-57-179840, and Research Disclosure No. 17465. Specific examples of DRR compounds for use in the present invention include the compounds described in the above-cited U.S. Pat. No. 4,500,626 (22nd to 44th columns). Particularly preferred among these compounds are compounds (1) to (3), (10) to (13), (16) to (19), (28) to (30), (33) to (35), (38) to (40), and (42) to (64) as described in U.S. Pat. No. 4,500,626. Other useful examples of DDR compounds include compounds as described in U.S. Pat. No. 4,639,408 (37th to 39th columns).

Dye-donating compounds other than the above described couplers or dye donating compounds represented by formula (LI) which may be used in the present invention include dye-silver compounds comprising an organic silver salt connected to a dye as described in *Research Disclosure,* May 1978, pp 54–58, azo dyes for use in heat developable silver dye bleaching processes as described in U.S. Pat. No. 4,235,957, and *Research Disclosure,* April 1976, pp. 30–32, or leuco dyes as described in U.S. Pat. Nos. 3,985,565, and 4,022,617.

The incorporation of a hydrophobic additives such as a dye-donating compound or a nondiffusive reducer into the layers of the light-sensitive element of the present invention can be accomplished by known methods as described, for example, in U.S. Pat. No. 2,322,027. A high-boiling point organic solvent as described in JP-A-59-83154, JP-A-59-178451, JP-A-59-178452, JP-A-59-178453, JP-A-59-178454, JP-A-59-178455, and JP-A-59-178457 can be optionally used in combination with a low boiling organic solvent having a boiling point of 50° to 160° C.

The addition amount of the high boiling organic solvent is in the range of from 10 g or less, preferably 5 g or less per 1 g of the dye donating compound used in combination therewith, or in the range of 1 cc or less, preferably 0.5 cc or less, particularly 0.3 cc or less per 1 g of binder.

The dispersion method using a polymer as described in JP-B-51-39853, and JP-A-51-59943 can be used in the present invention.

If a compound substantially insoluble in water is used, it may be contained in the binder as a dispersion of finely divided particles.

The dispersion of a hydrophobic compound in a hydrophilic colloid can be effected with the aid of various surface active agents. Examples of such surface active agents include those described in JP-A-59-157636 (pp. 37–38).

In the present invention, a compound capable of stabilizing images concurrent with the activation of development may be incorporated into the heat-developable light-sensitive element. Specific examples of such a compound which are preferably used in the present invention are described in U.S. Pat. No. 4,500,626 (51st to 52nd columns).

The heat-developable light-sensitive element may be coated on the same support as the dye-fixing element or on a different support therefrom The relationship of the heat-developable light-sensitive element and the dye-fixing element, and the support and the white reflective layer as described in U.S. Pat. No. 4,500,626 (57th column), is applicable to the present invention.

The constituent layers of heat-developable light-sensitive element and dye fixing element may comprise a high boiling organic solvent as a plasticizer, lubricant or agent for improving the release of the light sensitive element from the dye-fixing element. Specific examples of such high boiling organic solvents include those described in JP-A-62-253159, and JP-A-62-245253.

For the above described purposes, various silicone oils, including silicone oils ranging from dimethyl silicone oil to modified silicone oil, comprising various organic groups incorporated in dimethylsiloxane can be used. Examples of such silicone oils which can be effectively used include various modified silicone oils as described in technical data *Hensei Silicone Oil* (Modified Silicone Oil), p. 6–18B of Shin-Etsu Silicone Co., Ltd. Particularly useful among these modified silicone oils is carboxy-modified silicone (trade name: X-22-3710).

Other useful examples of such silicone oils include those described in JP-A 62-215953 and JP-A-63-449.

The heat-developable light-sensitive element or dye-fixing element of the present invention may comprise a fluorescent brightening agent. In particular, such a fluorescent brightening agent is preferably incorporated in the dye-fixing element or supplied externally, e.g., from the light-sensitive element Examples of such a fluorescent brightening agent include the compounds described in K. Veenkataraman, *The Chemistry of Synthetic Dyes,* vol. V, Chapter 8, and JP-A-61-143752. Specific examples of such fluorescent brightening agents include stilbene compounds, coumarin compounds, biphenyl compounds, benzooxazolyl compounds, naphthalimide compounds pyrazoline compounds, and carboxtyryl compounds. These fluorescent brightening agents can be used in combination with a discoloration inhibitor.

Examples of film hardeners which can be incorporated into the constituent layers of heat-developable light-sensitive element or dye-fixing element of the present invention include those described in U.S. Pat. No. 4,678,739 (41st column), and JP-A-59- 116655, JP-A-62-245261, and JP-A-61 18942 Specific examples thereof include aldehyde film hardeners (formaldehyde), aziridine film hardeners, epoxy film hardeners

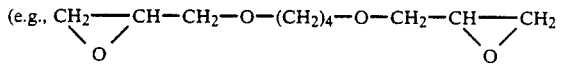

vinylsulfone film hardeners (e.g., N,N'-ethylenebis(-vinylsulfonylacetamide)ethane), N-methylol film hardeners (e.g., dimethylol urea), and high molecular film hardeners (e.g., the compounds described in JP-A-62-234157).

The constituent layers of the heat-developable light-sensitive element and dye-fixing element of the present invention may comprise various surface active agents as coating aids, for improving release and sliding properties for inhibiting charging effects, accelerating development or the like purposes Specific examples of such surface active agents are described in JP-A-62-173463, and JP-A-62 183457.

The constituent layers of heat-developable light-sensitive element and dye-fixing element of the present invention may comprise an organic fluoro compound for improving the sliding and release properties, for inhibiting charging effects or the like purposes. Typical examples of such an organic fluoro compound include the fluorine surface active agents as described in JPB-57-9053 (8th to 17th columns), and JP-A-61-20944, and JP-A-62-135826, oil fluorine compounds such an fluorine oil, and hydrophobic fluorine compounds such as a solid fluorine compound resin (e.g., tetrafluoroethylene resin).

The heat-developable light sensitive element or dye-fixing element of the present invention may comprise a matting agent. Matting agents for use in the present invention include the compounds described in JP-A-61-88256 (p. 29) such as silicon dioxide, polyolefin or poly-methacrylate. Other examples of matting agents for use in the present invention include the compounds described in JP-A-63-274944 and JP-A-63-274952, such as benzoguanamine resin bead, polycarbonate resin bead and AS (acrylonitrile styrene) resin bead.

The constituent layers of heat-developable light-sensitive element and dye-fixing element of the present invention may further comprise a heat solvent, an antifoaming agent, a sterilizer, an antimold agent, colloidal silica, or the like. Specific examples of these additives are described in JP-A 61-88256 (pp. 26–32).

The heat-developable light-sensitive element and/or dye-fixing element of the present invention may comprise an image formation accelerator. Such an image formation accelerator serves to accelerate the redox reaction of a silver salt oxidizer with a reducer, the formation or decomposition of a dye or release of a diffusive dye from a dye-donating substance, and transfer of a dye from the light-sensitive layer to the dye-fixing layer. In the light of physicochemical function, image formation accelerators are classified as bases or base precursors, nucleophilic compounds, high boiling organic solvents (oils), heat solvents, surface active agents, and compound which interact with silver or silver ion. However, the above described compound groups normally have composite functions, and hence, some of the above accelerating effects occur in combination as described in U.S. Pat. No. 4,678,739 (38th to 40th columns).

Examples of the base precursors includes salts of organic acids which undergo heat-decarboxylation with bases, and compounds which undergo intramolecular nucleophilic substitution reaction, Lossen rearrangement, or Beckmann rearrangement, to release amines. Specific examples of such base precursors are described in U.S. Pat. No. 4,511,493, and JP-A-62-65038.

In a system wherein the heat development and the dye transfer are simultaneously effected in the presence of a small amount of water, a base and/or base precursor is preferably incorporated into the dye-fixing element in order to improve the preservability of the light-sensitive element.

In addition, a combination of a difficultly-soluble metallic compound and a complexing compound thereof, as described in European Patent 210,660A, or compounds which undergo electrolysis to produce a base as described in JP-A-61-232451, may be used as base precursors. In particular, the former compounds are effective. The difficultly-soluble metallic compound and the complexing compound are preferably incorporated separately into each of the light-sensitive element and the dye-fixing element.

The heat-developable light-sensitive element and/or dye-fixing element of the present invention may comprise various development stop agents for the purpose of maintaining image quality constant despite variation in the processing temperature or development time.

The term "development stop agent" as used herein means a compound which readily neutralizes or reacts with a base after development to decrease th base concentration in the film, thereby stopping development; or a compound which interacts with silver or a silver salt after development to inhibit development. Specific examples of such a compound include acid precursors which release an acid when heated, electrophilic compounds which undergo a substitution reaction with a base present therewith when heated, nitrogen-containing heterocyclic compounds, mercapto compounds and precursors thereof. The development stop agents are further described in JP-A-62-253159 (pp. 31–32).

The support for the heat-developable light-sensitive element and dye-fixing element of the present invention comprises a substance which can withstand the processing temperature. In general, paper and synthetic high molecular compounds (film) are used as support materials. Specific examples of such support materials include polyethylene terephthalate, polycarbonate, polyvinyl chloride, polystyrene, polypropylene, polyimide, cellulose (e.g., triacetyl cellulose), materials comprising the above films and containing a pigment such as titanium oxide, synthetic paper prepared from a synthetic resin pulp such as polyethylene and a natural pulp, yankee paper, baryta paper, coated paper (particularly cast coated paper), metal, cloth, and glass.

The above described support materials can be used, singly or in combination. These support materials can be laminated with a synthetic high molecular compound such as polyethylene on one or both sides thereof.

Besides the above described support materials, the support materials described in JP-A-62-253159 (pp. 29–31) can be used in the present invention.

The support may comprise a hydrophilic binder and an antistatic agent such as alumina sol or semiconducting metal oxide (e.g., tin oxide) coated thereon.

The heat-developable light-sensitive element and/or dye-fixing element of the present invention may comprise an electrically-conductive heating layer as a heating means for heat development or dye diffusion transfer. A useful transparent or opaque heating element is described in JP-A-61-145544. Such an electrically-conductive layer also serves as an antistatic layer.

The heating temperature at which the heat development can be effected is preferably in the range of from about 50 to about 250° C., particularly from about 80° to about 180° C. The dye diffusion transfer process can be effected simultaneously with or after th heat development process. In the latter case, the heating temperature at which the transfer process can be effected in the range of from room temperature to the temperature range for the heat development process, particularly 50° C. to about 10° C. lower than the heating temperature used for the heat development process.

The transfer of the dyes can be effected by the action of heat alone. The transfer of the dyes can be accelerated by the use of a solvent.

As described in detail in JP-A-59-218443 and JP-A-61-238056, a process which comprises heating in the presence of a small amount of a solvent (particularly water) to simultaneously or sequentially effect development and transfer can be effectively used. In this process, the heating temperature is preferably in the range of from 50° C. to the boiling point of the solvent. For example, if the solvent is water, the heating temperature is in the range of from 50° C. to 100° C.

Examples of the solvent which can be used to accelerate development and/or transfer of the diffusive dyes to the dye-fixing layer include water, and a basic aqueous solution containing an inorganic alkaline metal salt or organic base as described with reference to image formation accelerators. Other examples of useful solvents include a low boiling solvent, and a mixture of a low boiling solvent and water, or a basic aqueous solution. These solvents can be used as a mixture with a surface activator, fog inhibitor, difficultly-soluble metallic salt, complexing compound, or the like.

These solvents can be provided to either or both of the dye-fixing element and the heat-developable light-sensitive element of the present invention. The amount of the solvent to be used is preferably less than the weight of the solvent corresponding to the maximum swelling volume of all of the coated films (particularly less than the value obtained by subtracting the weight of all coated films from the weight of the solvent corresponding to the maximum swelling volume of all of the coated films).

The solvent may be introduced into the light-sensitive layer or dye-fixing layer by the method described in JP-A-61-147244 (p. 26). Alternatively, the solvent can be contained in microcapsules before being incorporated into either or both of the light-sensitive element and the dye-fixing element.

Alternatively, a process may be employed wherein a hydrophilic heat solvent which stays solid at normal temperature but melts at an elevated temperature, is incorporated into the light-sensitive element or dye-fixing element. Such a hydrophilic heat solvent may be incorporated into either or both of the light-sensitive element and the dye-fixing element. The heat solvent may be incorporated into any of the emulsion layer, intermediate layer, protective layer and dye-fixing layer, and preferably into the dye-fixing layer and/or its adjacent layers.

Examples of such a hydrophilic heat solvent include ureas, pyrimidines, amides, sulfonamides, imides, alcohols, oxims and other heterocyclic groups.

In order to accelerate the transfer of a dye, a high boiling organic solvent may be incorporated into the heat-developable light-sensitive element and/or dye-fixing element of the present invention.

The heating at the development process and/or transfer process can be accomplished by bringing the material into contact with a heated block or plate, heating plate, hot presser, heat roller, or in proximity to halogen lamp heater, infrared or far infrared lamp or the like, or by passing the material through an atmosphere at elevated temperature The pressure conditions under which the heat-developable light-sensitive element and the dye-fixing element are brought into close contact to form a laminate and the method for pressing them, as described in JP-A-61-147244, can be applied to the present invention.

For the processing of the present heat-developable light-sensitive element, various heat developing apparatus can be used. For example, the apparatus described in JP-A-59-75247, JP-A-59-177547, JP-A-59-181353, and JP-A-60-18951, and JP-A-U-62-25944 (the term "JP-A-U" as used herein means an "unexamined published Japanese utility model application") are preferably used.

In order to imagewise expose a wet system or heat development system color diffusion transfer light-sensitive element, various methods can be used. For example, a camera is used to directly photograph scenery or persons. In another exposure process, the light-sensitive element is exposed to light through a reversal film or negative film by means of a printer or enlarger. In a process using an exposure apparatus in a copying machine, the light-sensitive element is exposed to light reflected from an original through a slit in a scanning manner. In another exposure process, the light-sensitive material is exposed to light emitted from a light emitting diode or a laser which has been modulated by an electrical signal representative of the image data. Alternatively, the light-sensitive element is exposed directly or through an optical system to light from an image display apparatus such as a CRT, liquid crystal display, electroluminescence display or plasma display which displays the image data.

Examples of exposure light source include natural light, a tungsten lamp, light-emitting diode, laser light source, CRT and other light sources as described in U.S. Pat. No. 4,500,626 (56th column).

Alternatively, a wavelength conversion element comprising a combination of a nonlinear optical element and a coherent light source such as laser light source can be used to imagewise expose the light-sensitive element of the present invention. A nonlinear optical element is an element wherein a nonlinearity between the polarization and electric field is developed upon exposure to a strong photoelectric field such as laser light. Useful nonlinear optical elements include lithium niobate, potassium dihydrogenphosphate (KDP), lithium iodate, inorganic compounds such as $BaB_2O_4$, urea derivatives, nitroaniline derivatives, nitropyridine-N-oxide derivatives such as 3-methyl-4-nitropyridine N-oxide (POM), or the compounds described in JP-A-61-53462 and JP-A-62-210432. The above described wavelength conversion element has been known in the form of monocrystal light waveguide type element, fiber type element or the like. Any of these types of elements can be used as the light source for exposing the photographic element of the present invention.

Examples of the above described image data which can be utilized in the present invention include image signals obtained from a video camera, electronic still camera, etc., a television video signal, an image signal obtained by dividing an original into a large number of picture elements by a scanner or the like, and an image signal obtained by a computer such as CG (computer graphics) or CAD (computeraided drawing).

The present invention is further described in the following examples, but the present invention is not construed as being limited thereto.

EXAMPLE 1

An integrated laminated type color diffusion transfer light-sensitive sheet and a cover sheet were prepared in the following manner.

Preparation of light-sensitive material

A light sensitive sheet was prepared by coating the following layers on a transparent polyethylene terephthalate support in the following order.

(1) Mordant layer containing 3.0 g/m$^2$ of gelatin and 3.0 g/m$^2$ of a polymer latex mordant, as given by Table 1.

(2) White reflective layer containing 20 g/m$^2$ of titanium dioxide and 2.0 g/m$^2$ of gelatin.

(3) Light screen layer containing 2.0 g/m$^2$ of carbon black and 1.5 g/m$^2$ of gelatin.

(4) Layer containing 0.44 g/m$^2$ of the following cyan dye-releasing redox compound, 0.09 g/m$^2$ of tricyclohexyl phosphate, 0.008 g/m$^2$ of 2,5-di-t-pentadecyl hydroquinone and 0.8 g/m$^2$ of gelatin.

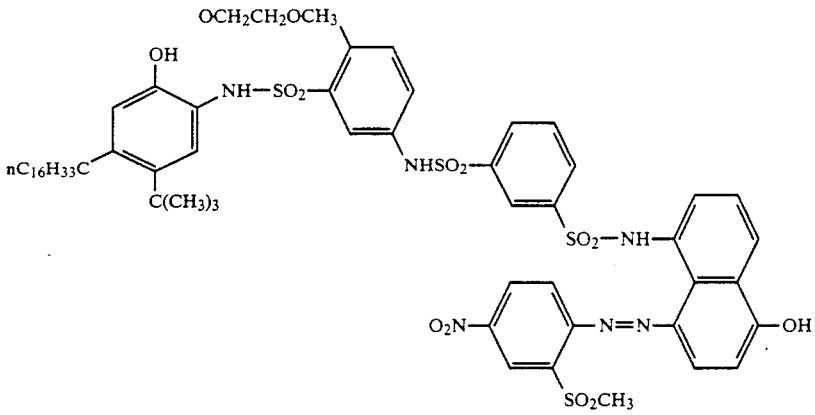

(5) Layer containing 1.5 g/m$^2$ of titanium dioxide and 0.40 g/m$^2$ of gelatin.

(6) Red-sensitive emulsion layer containing a red-sensitive internal latent image type direct positive silver bromide emulsion (1.03 g/m$^2$ as silver), 1.2 g/m$^2$ of gelatin, 0.04 g/m$^2$ of the following nucleating agent and 0.13 g/m$^2$ of the sodium salt of 2-sulfo 5-n-pentadecyl hydroquinone.

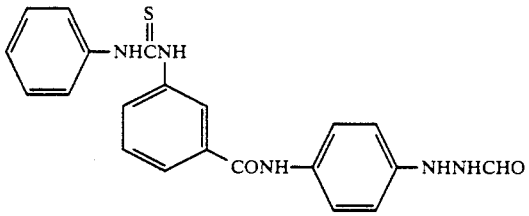

(7) Layer containing 0.43 g/m$^2$ of 2,5-di-t-pentadecyl hydroquinone, 0.1 g/m$^2$ of polymethyl methacrylate and 0.4 g/m$^2$ of gelatin.

(8) Layer containing 0.3 g/m$^2$ of the following magenta cyan-releasing redox compound, 0.08 g/m$^2$ of tricyclohexyl phosphate, 0.009 g/m$^2$ of 2,5-di-tert-pentadecyl hydroquinone and 0.5 g./m$^2$ of gelatin.

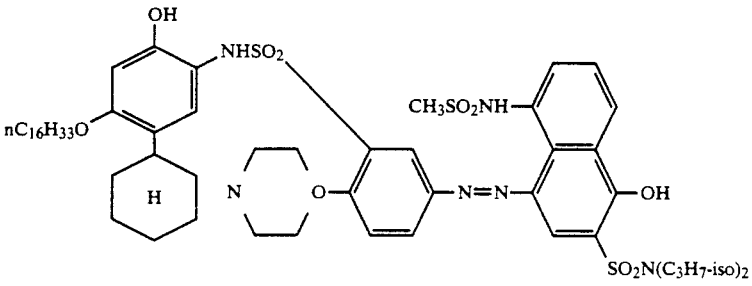

(9) Layer containing 0.8 g/m$^2$ of titanium dioxide, 0.25 g/m$^2$ of gelatin and 0.05 g/m$^2$ of the following compound.

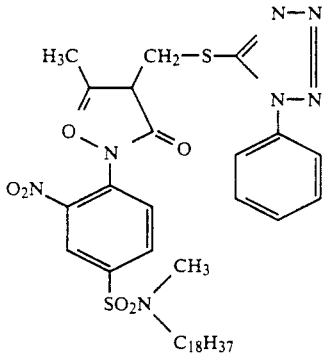

(10) Green-sensitive emulsion layer containing a green-sensitive internal latent image type direct positive silver bromide emulsion (0.82 g/m$^2$ as silver), 0.9 g/m$^2$ of gelatin, 0.03 mg/m$^2$ of the same nucleating agent as used in the layer (6) and 0.08 g/m$^2$ of the sodium salt of 2-sulfo-5-n-pentadecyl hydroquinone.

(11) The same as layer (7).

(12) Layer containing 0.5 g/m$^2$ of a yellow dye-releasing redox compound having the following structure, 0.13 g/m$^2$ of tricyclohexyl phosphate and 0.5 g/m$^2$ of gelatin.

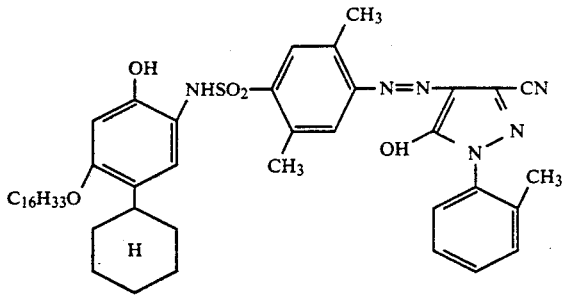

(13) Layer containing 0.23 g/m$^2$ of gelatin.

(14) Blue-sensitive emulsion layer containing a blue-sensitive internal latent image type direct positive silver bromide emulsion (1.09 g/m$^2$ as silver), 1.1 g/m$^2$ of gelatin, 0.04 mg/m$^2$ of the same nucleating agent as used inlayer (6) and 0.07 g/m$^2$ of the sodium salt of 2-sulfo-5-n-pentadecyl hydroquinone.

(15) Layer containing $4.0\times10^{-4}$ mol/m$^2$ of ultraviolet absorbers A and $4.0\times10^{-4}$ mol/m$^2$ of ultraviolet absorbers B each having the following structure, 0.08 g/m$^2$ of a fog inhibitor A having the following structure, 0.05 g/m$^2$ of 2,5-di-tert-pentadecyl hydroquinone and 0.10 g/m$^2$ of polymethyl methacrylate.

Ultraviolet Absorber A

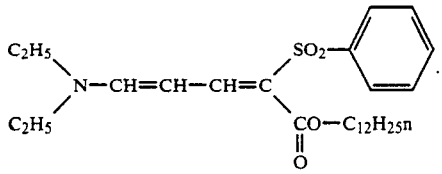

Ultraviolet Absorber B

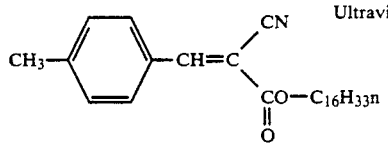

Fog Inhibitor A

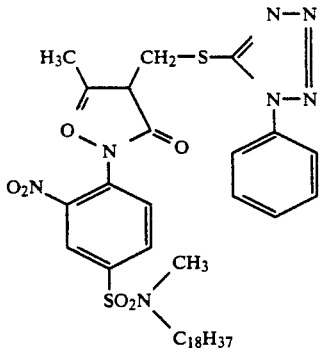

(16) Protective layer containing 0.10 g/m$^2$ of a polymethyl methacrylate latex having an average grain size of 4 μm, 0.3 g/m$^2$ of gelatin and 0.02 g/m$^2$ of triacroyltriazine.

Cover sheet

A cover sheet was prepared by coating the following layers (1) to (4) on a transparent polyethylene terephthalate support in the following order.

(1) Neutralizing layer having a coat of 9.0 g/m$^2$ of an 8:2 (weight ratio) acrylic acid-butyl acrylate copolymer having an average molecular weight of 50,000 and 0.18 g/m$^2$ of 1,4-bis(2,3-epoxypropoxy)-butane.

(2) A second neutralization timing layer having a coat of 7.5 g/m$^2$ of cellulose acetate having an acetylation degree of 51.0% and a methyl vinyl ethermaleic monomethyl ester alternating copolymer in a weight ratio of 95/5 and 0.825 mmol/m$^2$ of 1,3 bis(2-(1-phenyl-5-tetrazolylthio)ethylsulfonyl)-2-propanol.

(3) Auxiliary neutralizing layer having a coat of 0.735 g/m$^2$ of a methyl vinyl ether-maleic anhydride alternating copolymer, 0.315 g/m$^2$ of a styrene-maleic acid alternating copolymer and 0.45 g/m$^2$ of cellulose acetate having an acetylation degree of 55.0%.

(4) 1st neutralization timing layer having a solid content coat of 2.5 g/m$^2$ obtained by blending in a solid content ratio of 6:4, a polymer latex obtained by emulsion polymerization of styrene, butyl acrylate, acrylic acid and N-methylol acrylamide in a weight ratio of 49.7/42.3/4/4, and a polymer latex obtained by emulsion polymerization of methylmethacrylate, acrylic acid and N-methylol acrylamide in a weight ratio of 93/3/4.

| Composition of processing solution | |
|---|---|
| 1-p-Tolyl-4-hydroxymethyl-4-methyl-3-pyrazolidone | 14.0 g |
| Sodium t-butylhydroquinone sulfonate | 0.3 g |
| 5-Methyl benzotriazole | 3.5 g |
| Sodium sulfite (anhydride) | 0.2 g |
| Sodium salt of carboxymethyl cellulose | 58 g |
| Potassium hydroxide (28% aqueous solution) | 200 cc |
| Benzyl alcohol | 1.5 cc |
| Carbon black | 150 g |
| Water | 685 cc |

Each of the light-sensitive sheets thus prepared was exposed to light through a continuous wedge. The cover sheets thus prepared were then placed on each of the light-sensitive sheets. The resulting lamination was then passed between a pair of pressure rollers such that the processing solution was spread between the light-sensitive sheet and the cover sheet.

The film unit thus processed was then dried at a temperature of 40° C. for 10 days. The image density of the blue, green and red images was measured to locate areas wherein the initial density of each was 1.0. The film unit was then irradiated with light of 17,000 lux from a fluorescent tube for two weeks. The film unit was then remeasured for the decrease in the density of the blue (B), green (G) and red (R) images at a position where the initial density value of each image was 1.0. The results are shown in Table 1.

TABLE 1

| Light-Sensitive Sheet No. | Mordant No. | Decrease in Density due to Irradiation with Light B | G | R | Remarks |
|---|---|---|---|---|---|
| 1-1 | A (comparative) | 0.05 | 0.35 | 0.28 | Comparative |
| 1-2 | P-10 (present) | 0.04 | 0.23 | 0.17 | Present Invention |
| 1-4 | A and | 0.05 | 0.30 | 0.25 | Comparative |

TABLE 1-continued

| Light-Sensitive Sheet No. | Mordant No. | Decrease in Density due to Irradiation with Light B | G | R | Remarks |
|---|---|---|---|---|---|
| | Additive (a) | | | | |

Mordant A

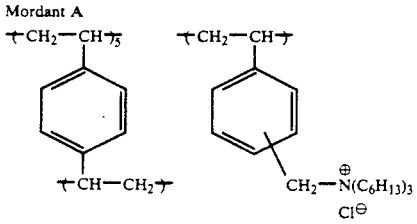

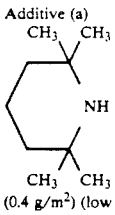

(0.4 g/m²) (low molecular discoloration inhibitor)

As shown in Table 1, the present polymer mordant improves the light fastness of the light-sensitive materials. In Comparative Sample 1-3, Additive (a), which has the similar structure and function as the discoloration inhibitor part of P-10, was added in an amount corresponding to the amount of such an inhibitor part in Sample 1-2. In Comparative Sample 103, the additive diffuses from the mordant layer, thus markedly reducing the desired effect.

EXAMPLE 2

In order to further demonstrate the light fastness enhancing effects of the present invention, the following light-sensitive element and image-receiving element were prepared.

Light-sensitive sheet

A light-sensitive sheet was prepared by coating the following layers on a transparent polyethylene terephthalate support.

Backing layer: (a) Backing layer containing 4.0 g/m² of carbon black and 2.0 g/m² of gelatin.

Emulsion layer side: (1) Layer containing 0.44 g/m² of the following cyan dye-releasing redox compound, 0.09 g/m² of tricyclohexyl phosphate, 0.008 g/m² of 2,5-di-t-pentadecyl hydroquinone and 0.8 g/m² of gelatin.

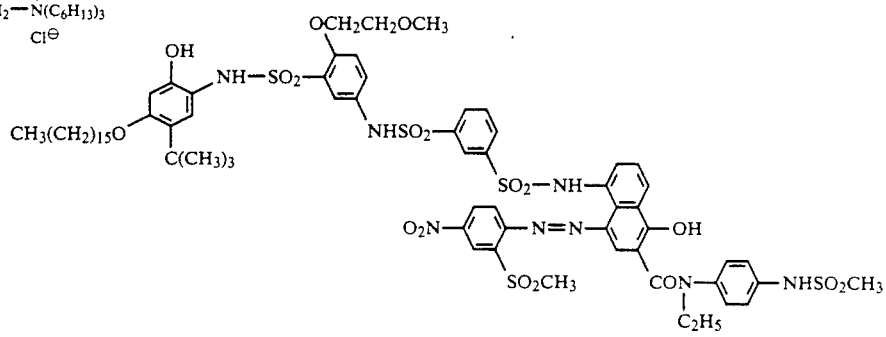

(2) Layer containing 0.5 g/m² of gelatin.

(3) Red-sensitive emulsion layer containing a red-sensitive internal latent image type direct positive silver bromide emulsion (0.6 g/m² as silver), 1.2 g/m² of gelatin, 0.015 mg/m² of a nucleating agent having the following structure and 0.06 g/m² of sodium salt of 2-sulfo-5-n-pentadecyl hydroquinone.

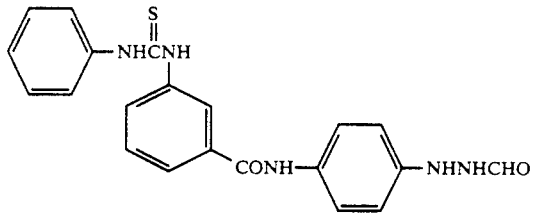

(4) Layer containing 0.43 g/m² of 2,5-di-t-pentadecyl hydroquinone, 0.1 g/m² of trihexyl phosphate and 0.4 g/m² of gelatin.

(5) Layer containing 0.3 g/m² of the following magenta dye-releasing redox compound, 0.08 g/m² of tricyclohexyl phosphate, 0.009 g/m² of 2,5-di-tert-pentadecyl hydroquinone and 0.5 g/m² of gelatin.

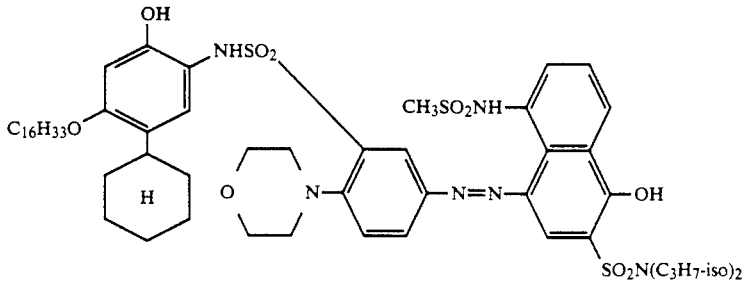

(6) Green-sensitive emulsion layer containing a green-sensitive internal latent image type direct positive silver bromide emulsion (0.42 g/m² as silver), 0.9 g/m² of gelatin, 0.013 mg/m² of the same nucleating agent as used in layer (3) and 0.07 g/m² of sodium salt of 2-sulfo 5-n-pentadecyl hydroquinone.

(7) The same layer as layer (4).

(8) Layer containing 0.53 g/m² of a yellow dye-releasing redox compound having the following structure, 0.13 g/m² of tricyclohexyl phosphate, 0.014 g/m² of 2,5-di-t-pentadecyl hydroquinone and 0.7 g/m² of gelatin.

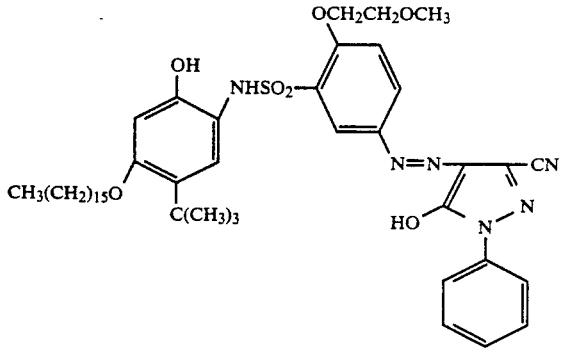

(9) Blue-sensitive emulsion layer containing a blue-sensitive internal latent image type direct positive silver bromide emulsion (0.6 g/m² as silver), 1.1 g/m² of gelatin, 0.019 mg/m² of the same nucleating agent as used inlayer (3) and 0.05 g/m² of the sodium salt of 2-sulfo-5-n-pentadecyl hydroquinone

(10) Layer containing 1.0 g/m² of gelatin.

Image-receiving sheet:

Paper support: 150-μm thick paper laminated with 30-μm thick polyethylene on both sides. The polyethylene on the image-receiving layer side comprises titanium oxide dispersed therein in an amount of 10% by weight.

Back side: (a) Backing layer containing 4.0 g/m² of carbon black and 2.0 g/m² of gelatin (b)

White layer containing 8.0 g/m² of titanium oxide and 1.0 g/m² of gelatin (c)

Protective layer containing 0.6 g/m² of gelatin

Image-receiving layer side:

(1) Neutralizing layer containing 22 g/m² of an acrylic acid-butylacrylate (molar ratio 8:2) copolymer having an average molecular weight of 50,000.

(2) Neutralization timing layer containing 4.5 g/m² of cellulose acetate having an acetylation degree of 51.3% (amount of acetic acid released by hydrolysis is 0.513 g per 1 g of specimen) and a styrene-maleic anhydride (molar ratio 1:1) copolymer having an average molecular weight of 10,000 in a weight proportion of 95:5

(3) Layer containing 1.6 g/m² of a solid content, obtained by blending in a solid content ratio of 6:4 a polymer latex obtained by emulsion polymerization of styrene, butylacrylate, acrylic acid and N-methylol acrylamide in a weight ratio of 49.7/42.3/4/4, and a polymer latex obtained by emulsion polymerization of methyl methacrylate, acrylic acid and N-methylol acrylamide in a weight ratio of 93/3/4

(4) Image-receiving layer obtained by coating 3.0 g/m² of the polymer mordant shown in Table 2 and 3.0 g/m² of the following compound:

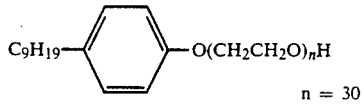

as a coating aid (5) Protective layer having a coat of 0.6 g/m² of . gelatin

| Processing solution: | |
|---|---|
| 1-p-Tolyl-4-hydroxymethyl-4-methyl-3-pyrazolidone | 6.9 g |
| Methyl hydroquinone | 0.3 g |
| 5-Methylbenzotriazole | 3.5 g |
| Sodium sulfite (anhydride) | 0.2 g |
| Sodium salt of carboxymethyl cellulose | 58 g |
| Potassium hydroxide (28% aqueous solution) | 200 cc |
| Benzyl alcohol | 1.5 cc |
| Water to make | 835 cc |

The light-sensitive sheets thus prepared were exposed to light through a color test chart. The image-receiving sheets thus prepared were then laminated onto the light-sensitive sheet. The following processing solution was then spread between the two sheets to a thickness of 60 μm using pressure rollers.

The processing was effected at a temperature of 25° C. 90 seconds after the start of processing, the light-sensitive sheet was peeled off of the image-receiving sheet. The image-receiving sheet was then allowed to dry.

Each of the image-receiving sheets was then irradiated with light of 17,000 lux from a fluorescent tube for two weeks. These image-receiving sheets were measured for the decrease in density of the B, G and R images at the position where the initial density value of each image was 1.0. The results are shown in Table 2.

TABLE 2

| Image-Receiving Sheet No. | Mordant No. | Decrease in Density due to Irradiation with Light B | G | R | Remarks |
|---|---|---|---|---|---|
| 2-1 | B | 0.15 | 0.13 | 0.20 | Comparative |
| 2-2 | P-13 | 0.10 | 0.09 | 0.14 | Present Invention |

Mordant B is represented by the following structure.

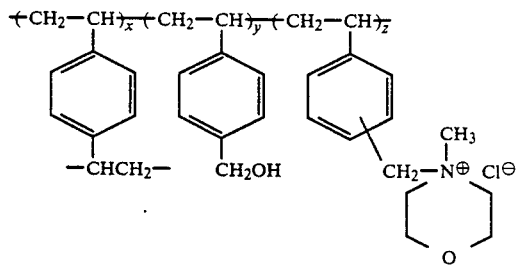

x:y:z = 5:5:90

As shown in Table 2, the present polymer mordant improves the light fastness of a light-sensitive material comprising the polymer mordant of the present invention.

EXAMPLE 3

A carbon black layer (3.0 g/m$^2$ of carbon black and 4.5 g/m$^2$ of gelatin) and a titanium white layer (3.0 g/m$^2$ of titanium white and 1.0 g/m$^2$ of gelatin) were sequentially coated as backing layers on the rear side of a polystyrene terephthalate support containing titanium white as a white pigment.

A light-sensitive sheet was then prepared by sequentially coating the following layers on the opposite side of the support.

(1) Neutralizing layer containing 4.0 g/m$^2$ of a polyacrylic acid, 4.0 g/m$^2$ of polyvinyl alcohol and 0.04 g/m$^2$ of 1,4-bis(2,3-epoxypropoxy)butane.

(2) Timing layer containing 6 g/m$^2$ of cellulose acetate having an acetylation degree of 55% and a methyl half ester of a 1:1 (molar ratio) copolymer of methylvinyl ether and maleic anhydride in a weight ratio of 95:5.

(3) Bond increasing layer containing 0.4 g/m$^2$ of hydroxyethyl methacrylate.

(4) Layer containing 2.5 g/m$^2$ of a solid content obtained by blending in a solid content ratio of 6:4 a polymer latex obtained by emulsion polymerization of styrene, butyl acrylate, acrylic acid, and N-methylolacrylic amide in a weight ratio of 49.7/42.3/4/4, and a polymer latex obtained by emulsion polymerization of methyl methacrylate, acrylic acid, and N-methylolacrylamide in a weight ratio of 93/3/4.

(5) Mordant layer containing 3 g/m$^2$ of the polymer latex mordant shown in Table 3 and 3 g/m2 of gelatin.

(6) Release layer containing 0.9 g/m$^2$ of hydroxyethyl cellulose and 0.03 g/m$^2$ of RFC-431 (surface active agent produced by 3M).

(7) Layer containing 4 g/m$^2$ of titanium white and 0.6 g/m$^2$ of gelatin.

(8) Layer containing 0.44 g/m$^2$ of the following cyan dye-releasing redox compound, 0.09 g/m$^2$ of tricyclohexyl phosphate, 0.008 g/m$^2$ of 2,5-di-t-pentadecyl hydroquinone and 0.8 g/m$^2$ of gelatin.

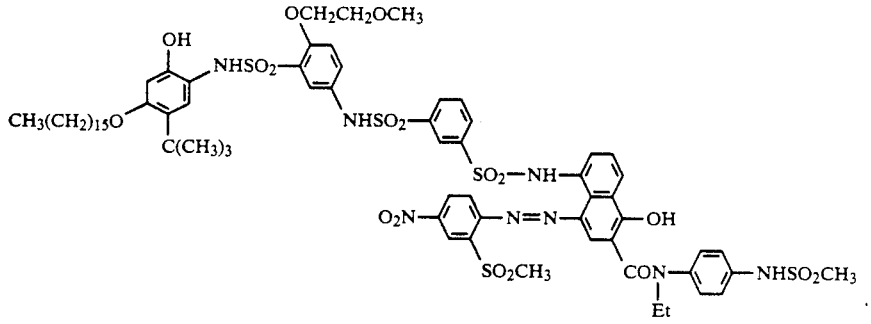

(9) Layer COntaining 0.5 g/m$^2$ of gelatin.

(10) Red-sensitive emulsion layer containing a red-sensitive internal latent image type direct positive silver bromide emulsion (0.6 g/m$^2$ in terms of amount of silver; grain size: 1.0 μm; octahedron), 1 g/m$^2$ of gelatin, 0.015 mg/m$^2$ of the following nucleating agent and 0.06 g/m$^2$ of sodium salt of 2-sulfo-5-n-pentadecyl hydroquinone.

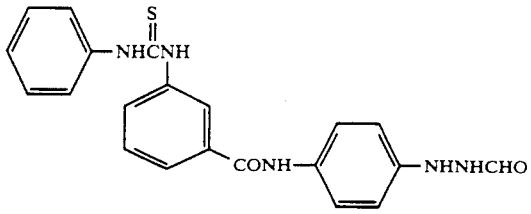

(11) Layer containing 0.43 g/m$^2$ of 2,5-di-t-pentadecyl hydroquinone, 0.1 g/m$^2$ of trihexyl phosphate and 0.4 g/m$^2$ of gelatin.

(12) Layer containing 0.5 g./m$^2$ of the following magenta dye-releasing redox compound, 0.1 g/m$^2$ of tricyclohexyl phosphate, 0.009 g/m$^2$ of 2,5-di-t-pentadecyl hydroquinone and 0.9 g/m$^2$ of gelatin.

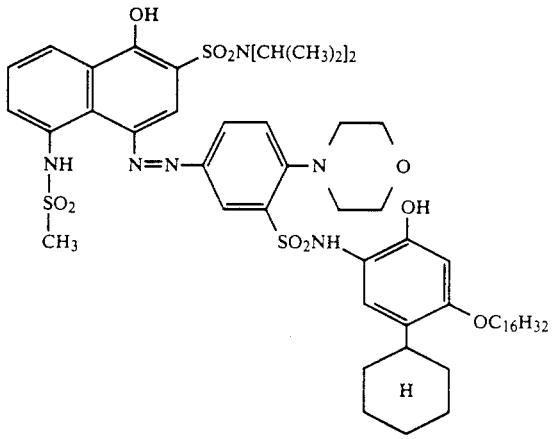

(13) Green-sensitive emulsion layer containing a green-sensitive internal latent image type direct positive silver bromide emulsion (0.45 g/m$^2$ as silver; grain size: 1.0 μm; octahedral grains), 0.75 g/m$^2$ of gelatin, 0.013 mg/m$^2$ of the same nucleating agent as used in layer (10) and 0.07 g/m$^2$ of sodium salt of 2-sulfo-5-n-pentadecyl hydroquinone.

(14) The same layer as layer (11).

(15) Layer containing 0.53 g/m$^2$ of a yellow dye-releasing redox compound having the following structure, 0.13 g/m$^2$ of tricyclohexyl phosphate, 0.014 g/m$^2$ of 2,5-di-t-pentadecyl hydroquinone and 0.7 g/m$^2$ of gelatin.

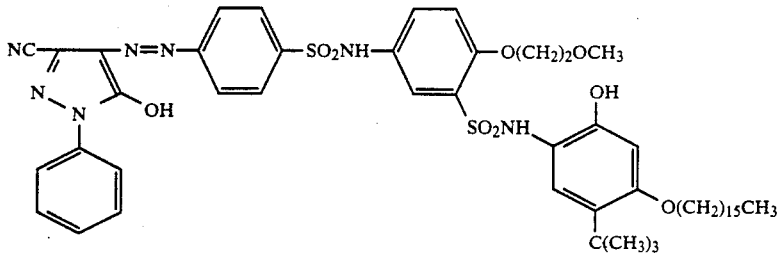

(16) Blue-sensitive emulsion layer containing a blue-sensitive internal latent image type direct positive silver bromide emulsion (0.6 g/m$^2$ as silver; grain size: 1.1 μm; octahedral grains), 1 g/m$^2$ of gelatin, 0.019 g/m$^2$ of the same nucleating agent as used in layer (10) and 0.06 g/m$^2$ of the sodium salt of 2-sulfo-5-n-pentadecyl hydroquinone.

(17) Ultraviolet absorbing layer containing the following two ultraviolet absorbing compounds in an amount of $4\times10^{-4}$ mol/m$^2$ each and 0.5 g/m$^2$ of gelatin.

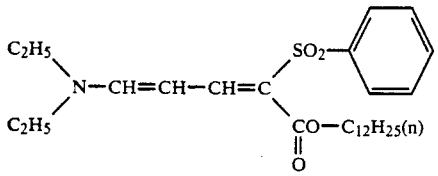

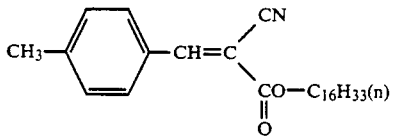

(18) Protective layer containing 1.0 g/m$^2$ of gelatin.

An alkaline processing solution containing a light screen was prepared in the following manner and packed into a processing solution pot.

| Processing solution: | |
|---|---|
| 1-m-Tolyl-4-hydroxymethyl-4-methyl-3-pyrazolidone | 10 g |
| 1-Phenyl-4-hydroxymethyl-4-methyl-3-pyrazolidone | 4 g |
| 5-Methylbenzotriazole | 6 g |
| Potassium sulfite | 8 g |
| Hydroxyethyl cellulose | 45 g |
| Potassium hydroxide | 64 g |
| Benzyl alcohol | 3.4 g |
| Carbon black | 150 g |
| Water to make | 1 kg |

These light-sensitive sheets were exposed to light through a continuous wedge. The above described processing solution was then spread between each of these light sensitive sheets and a gelatin-coated transparent polyethylene terephthalate sheet used as a cover sheet to a thickness of 70 μm with the aid of pressure rollers.

These light-sensitive sheets were then peeled off the release layer (6) 4 minutes after the start of processing at a temperature of 25° C. to obtain a color image. The image-receiving portion was then allowed to dry.

These light-sensitive sheets were then irradiated with light of 17,000 lux from a fluorescent tube for 1 week. These light-sensitive sheets were then measured for the decrease in the B (blue), G (green) and R (red) image density at the position where the initial density value of each image was 1.0.

The results are shown in Table 3.

TABLE 3

| Light-Sensitive Sheet No. | Mordant No. | Decrease in Density due to Irradiation with Light B | G | R | Remarks |
|---|---|---|---|---|---|
| 3-1 | C | 0.16 | 0.20 | 0.19 | Comparative |
| 3-2 | P-12 | 0.11 | 0.13 | 0.14 | Present Invention |

The Mordant C is represented by the following structure.

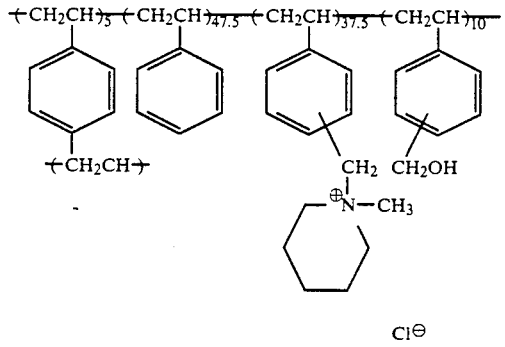

As shown in Table 3, the present polymer mordant improves the light fastness of a light-sensitive material comprising the polymer mordant of the present invention.

EXAMPLE 4

Color light-sensitive materials and image-receiving materials having the layer structure shown in Tables 4 and 5 were prepared.

TABLE 4

Structure of Light-Sensitive Material

| Layer No. | Layer Name | Additive | Added Amount (g/m$^2$) |
|---|---|---|---|
| 6th layer | Protective layer | Gelatin | 0.91 |
| | | Matting agent | 0.03 |
| | | Surface active agent (1)* | 0.06 |
| | | Surface active agent (2)* | 0.13 |
| | | Film hardener (1)* | 0.01 |
| | | $Zn(OH)_2$ | 0.32 |
| 5th layer | Blue-sensitive | Emulsion (III) | 0.58 as silver |

TABLE 4-continued

| | | | |
|---|---|---|---|
| | layer | Gelatin | 0.68 |
| | | Fog inhibitor (1)* | $1.36 \times 10^{-3}$ |
| | | Yellow dye-donating substance (I) | 0.50 |
| | | High boiling organic solvent (1)* | 0.25 |
| | | Electron donor (ED-1)* | 0.35 |
| | | Surface active agent (3)* | 0.05 |
| | | Film hardener (1)* | 0.01 |
| | | Water-soluble polymer (1)* | 0.02 |
| 4th layer | Intermediate layer | Gelatin | 0.75 |
| | | Reducer (ED-2)* | 0.11 |
| | | Surface active agent (1)* | 0.02 |
| | | Surface active agent (4)* | 0.07 |
| | | Water-soluble polymer (1)* | 0.02 |
| | | Electron transfer agent (x) | 0.09 |
| | | Film hardener (1)* | 0.01 |
| 3rd layer | Green-sensitive layer | Emulsion (II) | 0.41 as silver |
| | | Gelatin | 0.47 |
| | | Fog inhibitor (1)* | $1.25 \times 10^{-3}$ |
| | | Magenta dye-releasing substance (2) | 0.37 |
| | | High boiling organic solvent (1)* | 0.19 |
| | | Electron donor (ED-1)* | 0.20 |
| | | Surface active agent (3)* | 0.04 |
| | | Film hardener (1)* | 0.01 |
| 3rd layer | Green-sensitive layer | Water-soluble polymer (1)* | 0.02 |
| 2nd layer | Intermediate layer | Gelatin | 0.80 |
| | | $Zn(OH)_2$ | 0.31 |
| | | Reducer (ED-2)* | 0.11 |
| | | Surface active agent (1)* | 0.06 |
| | | Surface active agent (4)* | 0.10 |
| | | Water-soluble polymer (1)* | 0.03 |
| | | Film hardener (1)* | 0.01 |
| 1st layer | Red-sensitive layer | Emulsion (I) | 0.36 as silver |
| | | Sensitizing dye (D-2) | $1.07 \times 10^{-3}$ |
| | | Gelatin | 0.49 |
| | | Fog inhibitor (1)* | $1.25 \times 10^{-3}$ |
| | | Cyan dye-donating substance (3) | 0.37 |
| | | High boiling organic solvent (1)* | 0.18 |
| | | Electron donor (ED-1)* | 0.20 |
| | | Surface active agent (3)* | 0.04 |
| | | Film hardener (1)* | 0.01 |
| | | Water-soluble polymer (1)* | 0.02 |
| Support (1) | | | |
| Backing layer | | Carbon black | 0.44 |
| | | Polyester | 0.30 |
| | | Polyvinyl chloride | 0.30 |

Water soluble polymer (1)* $-CH_2-CH-$

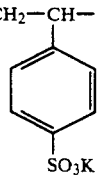

Surface active agent (1)* Aerosol OT

TABLE 4-continued

Surface active agent (2)*

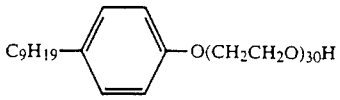

Surface active agent (3)*

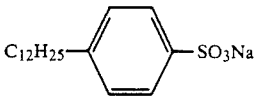

Surface active agent (4)*

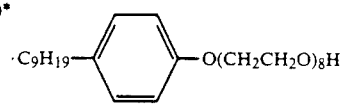

Film hardener (1)* 1,2-Bis(vinylsulfonylacetamide)-ethane
High boiling organic solvent (1)* Tricyclohexyl-phosphate Fog inhibitor (1)*

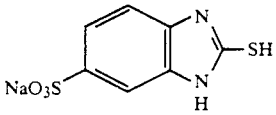

Electron donor (ED-1)*

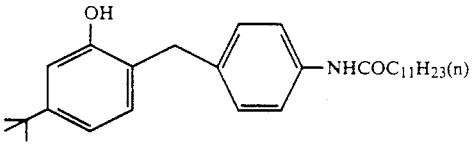

Electron transfer agent (x)*

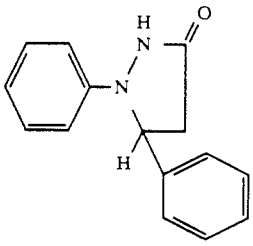

Reducer (ED-2)*

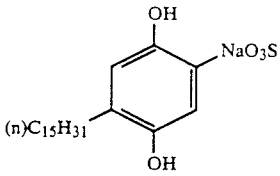

Sensitizing dye (D-2)*

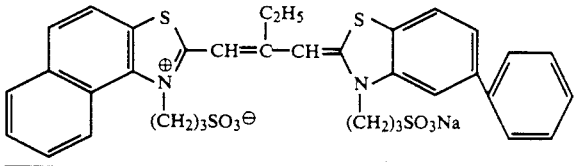

The preparation of Emulsion (I) for the 1st layer is described below.

600 ml of an aqueous solution containing sodium chloride and potassium bromide and an aqueous solution of silver nitrate (obtained by dissolving 0.59 mol of silver nitrate in 600 ml of water) were simultaneously added to an aqueous solution of gelatin (obtained by adding 20 g of gelatin and 3 g of sodium chloride to 1,000 ml of water and maintaining at a temperature of 75° C) at a constant flow rate with vigorous stirring over 40 minutes. Thus, a monodisperse emulsion of cubic silver bromochloride grains having an average grain size of 0.35 μm (bromide content: 80 mol%) was obtained.

The emulsion was then washed with water and desalted. The emulsion was then chemically sensitized with 5 mg of sodium thiosulfate and 20 mg of 4-hydroxy-6-methyl-1,3,3a,7-tetraazaindene at a temperature of 60° C. The yield of the emulsion was 600 g.

The preparation of Emulsion (II) for the 3rd layer is described below.

600 ml of an aqueous solution containing sodium chloride and potassium bromide, an aqueous solution of silver nitrate (obtained by dissolving 0.59 mol of silver nitrate in 600 ml of water) and the following dye solution (I) were simultaneously added to an aqueous solution of gelatin (obtained by adding 20 g of gelatin and 3 g of sodium chloride to 1,000 ml of water and maintaining at a temperature of 75° C.) at a constant flow rate with vigorous stirring over 40 minutes. Thus, a monodisperse emulsion of cubic silver bromochloride grains having an average grain size of 0.35 μm (bromide content: 80 mol%) was obtained.

The emulsion was then washed in water and desalted. The emulsion was then chemically sensitized with 5 mg of sodium thiosulfate and 20 mg of 4-hydroxy-6-methyl-1,3,3a,7-tetraazaindene at a temperature of 60° C. The yield of the emulsion was 600 g.

Dye solution (I): Solution obtained by dissolving 160 mg of the following sensitizing dye (D-1) in 400 ml of methanol

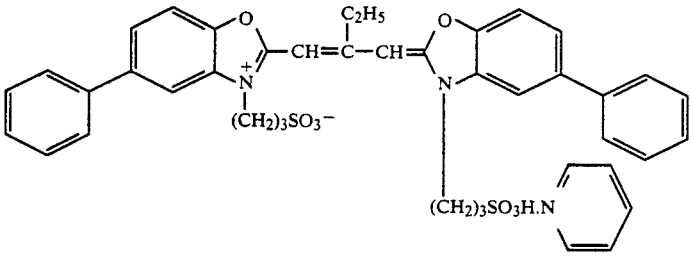

The preparation of Emulsion (III) for the 5th layer is described below.

1,000 ml of an aqueous solution containing potassium iodide and potassium bromide and an aqueous solution of silver nitrate (obtained by dissolving 1 mol of silver nitrate in 1,000 ml of water) were simultaneously added to an aqueous solution of gelatin (obtained by adding 20 g of gelatin and potassium bromide in 1,000 ml of water and maintaining at a temperature of 50° C.) with vigorous stirring while the pAg thereof was kept constant. Thus, a monodisperse emulsion of octahedral silver bromoiodide grains having an average grain size of 0.5 μm (bromide content: 5 mol%) was obtained.

After being washed with water and desalted, the emulsion was then subjected to gold and sulfur sensitization with 5 mg of chloroauric acid (tetrahydrate) and 2 g of sodium thiosulfate at a temperature of 60° C. The yield of the emulsion was 1 kg.

The preparation of gelatin dispersions of the dye-donating substances is described below.

13 g of a yellow dye-donating substance (1), 6.5 g of a high boiling organic solvent (1) and 6.5 g of an electron donor (ED-1) were dissolved in 37 ml of cyclohexanone. The solution was then mixed with 100 g of a 10% aqueous solution of gelatin, and 60 ml of a 2.5% aqueous solution of sodium dodecylbenzenesulfonate with stirring. The mixture was then dispersed in a homogenizer at 10,000 rpm for 10 minutes to provide a dispersion of the yellow dye-donating substance as used below.

16.8 g of a magenta dye-donating substance (2), 8.4 g of a high boiling organic solvent (1) and 6.3 g of an electron donor (ED-1) were dissolved in 37 ml of cyclohexanone. The solution was then mixed with 100 g of a 10% aqueous solution of gelatin and 60 ml of a 2.5% aqueous solution of sodium dodecylbenzenesulfonate with stirring. The mixture was then dispersed in a homogenizer at 10,000 rpm for 10 minutes to provide a dispersion of the magenta dye-donating substance as used below.

15.4 g of a cyan dye-donating substance (3), 7.7 g of a high boiling organic solvent (1) and 6.0 g of an electron donor (ED-1) were dissolved in 37 ml of cyclohexanone. The solution was then mixed with 100 g of a 10% aqueous solution of gelatin and 60 ml of a 2.5% aqueous solution of sodium dodecylbenzenesulfonate with stirring. The mixture was then dispersed in a homogenizer at 10,000 rpm for 10 minutes to provide a dispersion of the cyan dye-donating substance as used below.

Yellow dye-donating substance (1)

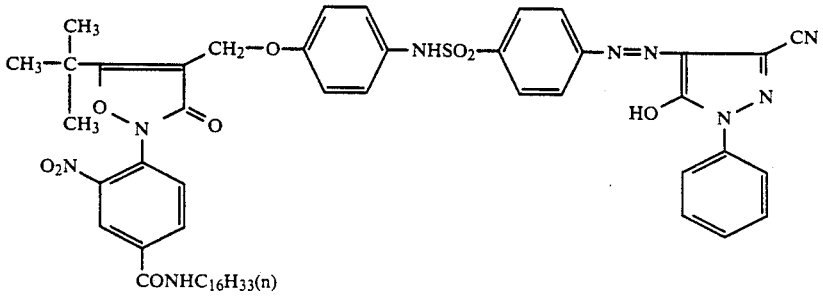

-continued

Magenta dye-donating substance (2)

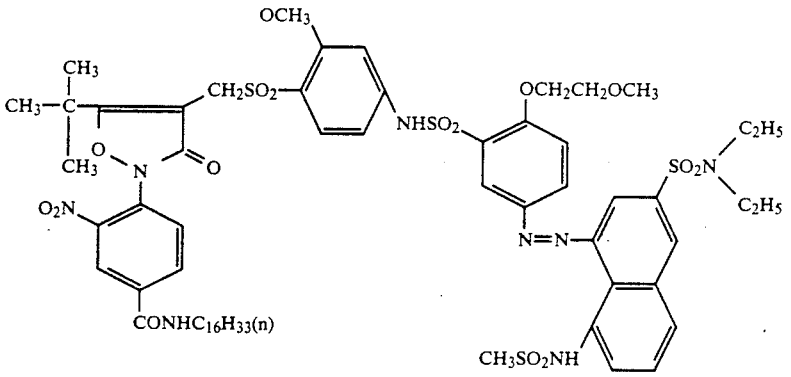

Cyan dye-donating substance (3)

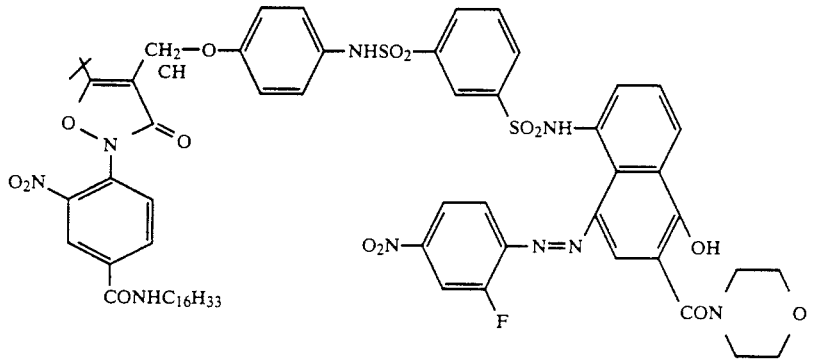

TABLE 5

Structure of image-receiving material (1)

| Layer No. | Additive | Added Amount ($g/m^2$) |
|---|---|---|
| 3rd layer | Gelatin | 0.05 |
| | Silicone oil (1)* | 0.04 |
| | Surface active agent (1)* | 0.001 |
| | Surface active agent (2)* | 0.02 |
| | Surface active agent (3)* | 0.10 |
| | Matting agent (1)* | 0.02 |
| | Ultraviolet absorber (1)* | 0.02 |
| | Ultraviolet absorber (2)* | 0.02 |
| | Ultraviolet absorber (3)* | 0.02 |
| | Guanidine picrate | 0.45 |
| | Water-soluble polymer (1)* | 0.24 |
| 2nd layer | Mordant (1)* | 2.35 |
| | Water-soluble polymer (1)* | 0.21 |
| | Gelatin | 1.40 |
| | Water-soluble polymer (3)* | 0.60 |
| | High boiling solvent (1)* | 1.40 |
| | Guanidine picrate | 1.80 |
| | Surface active agent(4)* | 0.02 |
| 1st layer | Gelatin | 0.45 |
| | Surface active agent (3)* | 0.01 |
| | Water-soluble polymer (1)* | 0.04 |
| | Film hardener (1)* | 0.30 |
| 1st backing | Gelatin | 0.25 |
| | Film hardener (1)* | 0.25 |
| 2nd backing | Gelatin | 0.44 |
| | Silicone oil (1)* | 0.08 |
| | Surface active agent (4)* | 0.05 |
| | Matting agent (2)* | 0.09 |
| | Surface active agent (5)* | 0.01 |

Silicone oil (1)*

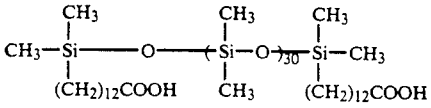

TABLE 5-continued

Surface active agent (1)*

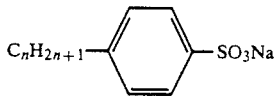

(n: ca. 12.6)

Surface active agent (2)*

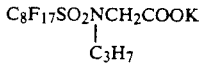

Surface active agent (3)*

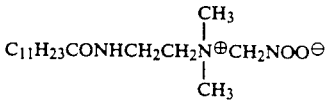

Surface active agent (4)*

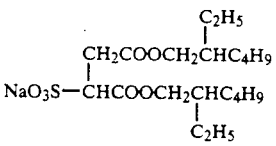

Surface active agent (5)*

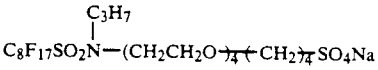

Water-soluble polymer (1)*
Sumicagel L5-H (Sumitomo Chemical Co., Ltd.)
Water-soluble polymer (2)*
Dextran (molecular weight: 70,000)

TABLE 5-continued

Water-soluble polymer (3)*

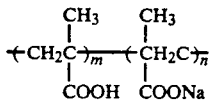

(molecular weight: about 500,000)

Mordant (1)*

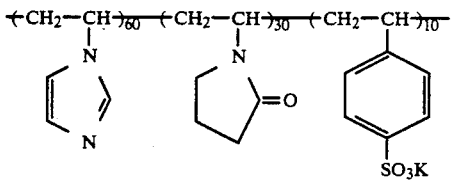

High boiling organic solvent (1)*
Reofos 95 (Ajinomoto Co., Inc.)

Film hardener (1)*

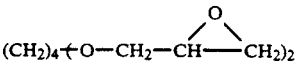

Matting agent (1)*
Silica
Matting agent (2)*
Benzoguanamine resin (average grain diameter: 15 μm)
Ultraviolet absorber (1)*

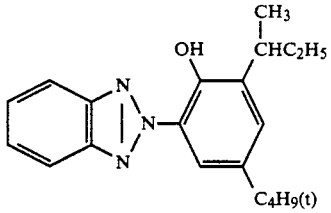

(2)*

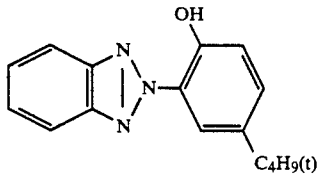

(3)*

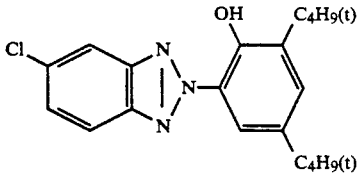

Support (1)*

| | |
|---|---|
| Gelatin | 0.2 μm |
| Polyethylene (Density: 0.942 g/m²) | 45 μm |
| Paper (Density: 1.08 g/m²) (LBKP*1/NGKP*2 = 1/1 | 101 μm |
| Sodium stearate | 1 wt % |
| Sulfuric acid band | 2 wt % |
| Polyethylene (Density: 0.967 g/m²) | 30 μm |
| Gelatin | 0.2 μm |
| Backing side | |

*1LBKP: Broadleaf tree bleached sulfate pulp
*2NBKP: Coniferous tree bleached sulfate pulp Image-receiving materials (2) and (3) were prepared in the same manner as described above except that the mordant (1) was replaced by the following mordants, and the following additives were added respectively.

| | Mordant (g/m²) | Additive (a) (g/m²) |
|---|---|---|
| Image-receiving material (2) | Mordant (1) (2.35) | Additive (a) (0.5) |
| (3) | Mordant P-4 (2.4) | None |

Additive (a)

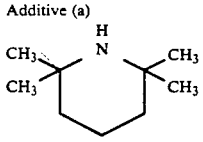

The above described multilayer color light-sensitive material (1) was exposed to light of 5,000 lux from a tungsten lamp through B, G, R and gray color separation filters having a continuous density gradation for 1/10 second.

Water was then supplied to the thus exposed light-sensitive material on its emulsion surface at a rate of 15 ml/m² through a wire bar, while the light-sensitive material was carried at a linear speed of 20 mm/sec. The light-sensitive material was immediately laminated on the image-receiving materials (1) to (3) in such a manner that they were brought into contact with each other on the film surface.

The laminations were then heated for 20 to 30 seconds by means of a heated roller to keep the temperature of the wet film at 85° C. When the light-sensitive material was peeled off of the image-receiving materials, blue, green, red and gray images were formed on the image-receiving materials corresponding to the B, G, R and gray color separation filters.

A transparent film having an ultraviolet absorbing layer was laminated on the film surface of the image-receiving materials having these images thereon. The laminations were then irradiated with xenon light of 100,000 lux on the color images by means of Atras C.I 65 weatherometer over 7 days. The color image density was measured before and after irradiation with xenon light to evaluate the light fastness of the color images.

The maximum density (reflective density) of these color images and the dye residue at a reflective density of 1.0 were measured. The results are shown in Table 6.

TABLE 6

| Color Image | Image-receiving Material | Maximum Density | % Dye Residue | Remarks |
|---|---|---|---|---|
| Yellow | (1) | 2.05 | 0.80 | Comparative |
| " | (2) | 2.06 | 0.79 | " |
| " | (3) | 2.05 | 0.85 | Present Invention |
| Magenta | (1) | 2.19 | 0.78 | Comparative |
| " | (2) | 2.19 | 0.78 | " |
| " | (3) | 2.18 | 0.84 | Present Invention |
| Cyan | (1) | 2.23 | 0.83 | Comparative |
| " | (2) | 2.22 | 0.83 | " |
| " | (3) | 2.23 | 0.87 | Present Invention |

$$\% \text{ Dye residue} = \frac{\text{Dye density after a 7 day irradiation with xenon light}}{\text{Dye density before irradiation with light}} \times 100$$

As shown in Table 6, the light-sensitive materials comprising the present mordant exhibit a high maximum density and an improved fasteners to light.

These light-sensitive materials exhibited a similar in light fastness when the support was substituted with a 100μm thick polycarbonate support.

EXAMPLE 5

A light-sensitive material was prepared according to the structure shown in Table 7.

TABLE 7

| Structure of Light-Sensitive Material | | | |
|---|---|---|---|
| Layer No. | Layer Name | Additive | Added Amount ($g/m^2$) |
| 6th layer | Protective layer | Gelatin | 0.9 |
| | | Matting agent (silica) | 0.116 |
| | | Water-soluble polymer (1) | 0.228 |
| | | Surface active agent (1) | 0.064 |
| | | Surface active agent (2) | 0.036 |
| | | Film hardener | 0.018 |
| | | Surface active agent (3) | 0.06 |
| 5th layer | Green-sensitive layer | Emulsion (I) | 0.4 |
| | | Acetylene compound | 0.022 |
| | | Yellow dye-donating substance (1) | 0.45 |
| | | High boiling organic solvent (1) | 0.225 |
| | | Reducer (1) | 0.009 |
| | | Mercapto compound (1) | 0.009 |
| | | Water-soluble polymer (2) | 0.02 |
| | | Film hardener | 0.013 |
| | | Gelatin | 0.64 |
| | | Surface active agent (5) | 0.045 |
| 4th layer | Intermediate layer | Gelatin | 0.7 |
| | | $Zn(OH)_2$ | 0.3 |
| | | Surface active agent (1) | 0.001 |
| | | Water-soluble polymer (2) | 0.003 |
| | | Film hardener | 0.014 |
| | | Surface active agent (4) | 0.029 |
| 3rd layer | Red-sensitive layer | Emulsion (IV) | 0.21 |
| | | Oraganic silver salt (1) | 0.035 as silver |
| | | Organic silver salt (2) | 0.035 as silver |
| | | Gelatin | 0.44 |
| | | Magenta dye-donating substance | 0.3 |
| | | High boiling organic solvent (1) | 0.15 |
| | | Reducer (1) | 0.006 |
| | | Mercapto compound (1) | 0.003 |
| | | Water-soluble polymer (2) | 0.013 |
| | | Surface active agent (5) | 0.03 |
| | | Film hardener (1) | 0.009 |
| 2nd layer | Intermediate layer | Gelatin | 0.77 |
| | | $Zn(OH)_2$ | 0.3 |
| | | Surface active agent (4) | 0.047 |
| | | Water-soluble polymer | 0.038 |
| | | Surface active agent (1) | 0.046 |
| | | Film hardener (1) | 0.016 |
| 1st layer | Infrared-sensitive layer | Emulsion (VII) | 0.26 |
| | | Organic silver salt (1) | 0.035 as silver |
| | | Organic silver salt (2) | 0.035 as silver |
| | | Mercapto compound (2) | $4 \times 10^{-4}$ |
| | | Sensitizing dye | $5 \times 10^{-5}$ |
| | | Cyan dye-donating substance | 0.325 |
| | | High boiling solvent (1) | 0.162 |

TABLE 7-continued

| Layer No. | Layer Name | Structure of Light-Sensitive Material: Additive | Added Amount ($g/m^2$) |
|---|---|---|---|
| | | Reducer (1) | $8.7 \times 10^{-3}$ |
| | | Mercapto compound (1) | 1.013 |
| | | Surface active agent (5) | 0.032 |
| | | Water-soluble polymer (2) | 0.018 |
| | | Gelatin | 0.5 |
| Support (polyethylene terephthalate: 100 μm thick) | | | |
| Backing layer | | Carbon black | 0.44 |
| | | Polyester | 0.30 |
| | | Polyvinyl alcohol | 0.30 |

High boiling organic solvent (1): Trinonyl phosphate

Water soluble polymer (1): Sumicagel L-5 (H) (Sumitomo Chemical Co., Ltd.)

Water-soluble polymer (2):

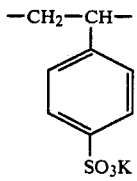

Surface active agent (1): Aerosol OT

Surface active agent (2):

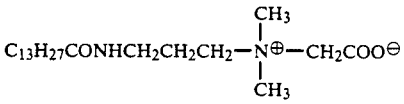

Surface active agent (3):

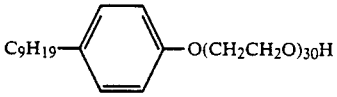

Surface active agent (4):

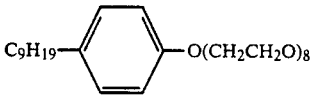

Surface active agent (5):

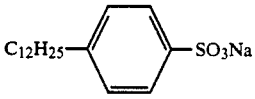

Film hardener: 1,3-Vinylsulfonyl-2-propanol

Acetylene compound:

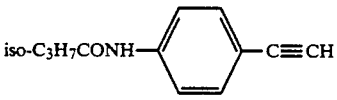

Reducer (1):

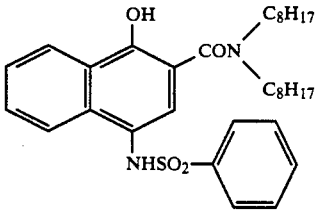

Mercapto compound (1)

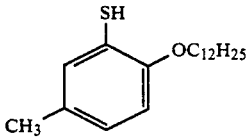

TABLE 7-continued

| Layer No. | Layer Name | Structure of Light-Sensitive Material: Additive | Added Amount ($g/m^2$) |
|---|---|---|---|
| Mercapto compound (2): | | 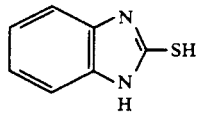 | |
| Sensitizing dye: | | 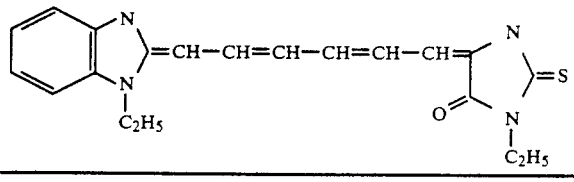 | |

The preparation of the emulsion for the 5th layer is described below.

Emulsion (I)

The following solution I and solution II were added to an aqueous solution of gelatin (obtained by dissolving 20 g of gelatin, 3 g of sodium chloride and 0.015 g of the following compound:

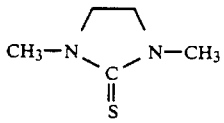

in 800 ml of water and maintaining at a temperature of 65° C.) with vigorous stirring for 70 minutes. At the time of the commencement of the addition of the solutions I and II, a dye solution obtained by dissolving 0.24 g of a sensitizing dye (A):

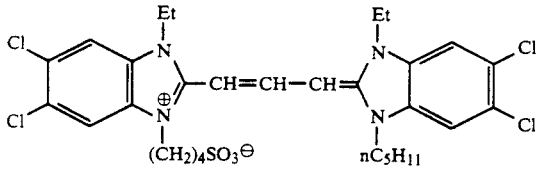

in a solution of 120 cc of methanol in 120 cc of water was added to the system over a period of 60 minutes.

| | Solution I (600 ml total) | Solution II (600 ml total) |
|---|---|---|
| $AgNO_3$ (g) | 100 | — |
| KBr (g) | — | 56 |
| NaCl (g) | — | 7 |

Immediately after the completion of the addition of the solutions I and II, 2 g of KBr was dissolved in 0 ml of water, and the solution thus obtained was added to the system. The system was then allowed to stand for 10 minutes.

After being washed with water and desalted, the emulsion was then adjusted with 25 g of gelatin and 100 ml of water to pH 6.4 and pAg 7.8. Thus, a monodisperse emulsion of cubic silver halide grains with a grain size of about 0.5 μm was obtained.

1.3 mg of triethylthiourea and 100 mg of 4-hydroxy-6-methyl-1,3,3a,7-tetraazaindene were then added to the emulsion while the latter was kept at a temperature of 60° C. to subject the emulsion to optimum chemical sensitization. The yield of the emulsion was 650 g.

The preparation of the emulsion for the 3rd layer is described below.

Emulsion (IV)

The following solution I and solution II were added to an aqueous solution of gelatin (obtained by dissolving 20 g of gelatin, 2 g of sodium chloride and 0.015 g of the following compound:

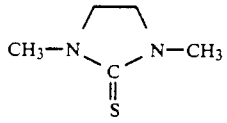

in 800 ml of water and maintaining at a temperature of 65° C.) with vigorous stirring for 670 minutes. At the time of commencement of the addition of the solutions I and II, a dye solution obtained by dissolving 0.16 g of a sensitizing dye (B):

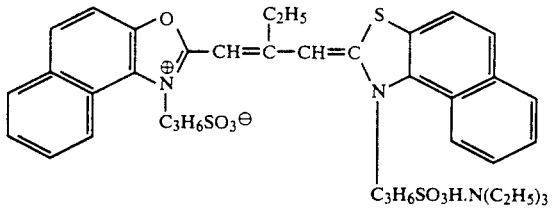

in a solution of 80 cc of methanol was added to the system over a period of 40 minutes.

| | Solution I (600 ml total) | Solution II (600 ml total) |
|---|---|---|
| $AgNO_3$ (g) | 100 | — |
| KBr (g) | — | 56 |
| NaCl (g) | — | 7 |

After the completion of the addition of the solutions I and II, the emulsion was allowed to stand for 10 minutes to cool. After being washed with water and desalted, the emulsion was then adjusted with 25 g of gelatin and 100 ml of water to pH 6.5 and pAg 7.8.

The emulsion was then subjected to optimum chemical sensitization with triethylthiourea and 4-hydroxy-6-methyl-1,3,3a,7-tetraazaindene at a temperature of 60° C.

Thus, a monodisperse emulsion of cubic silver halide grains with a grain size of about 0.35 μm was obtained. The yield of the emulsion was 650 g.

The preparation of the emulsion for the 1st layer is described below.

Emulsion (VII)

600 ml of an aqueous solution containing 49 g of potassium bromide and 10.5 g of sodium chloride and an aqueous solution of silver nitrate (obtained by dissolving 0.59 mol of silver nitrate in 600 ml of water) were simultaneously added to an aqueous solution of gelatin (obtained by dissolving 20 g of gelatin, 4 g of sodium chloride and 0.02 g of the following compound:

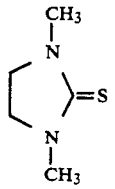

in 1,000 ml of water, and maintaining at a temperature of 65° C.) at a constant flow rate with vigorous stirring for 50 minutes. After being washed with water and desalted, the emulsion was then adjusted with 25 g of gelatin and 2000 ml of water to pH 6.4. The emulsion was then subjected to optimum chemical sensitization with triethylthiourea and 4-hydroxy 6-methyl-1,3,3a,7-tetraazaindene. Thus, 700 g of a monodisperse emulsion of cubic silver halide grains having an average grain size of 0.4 μm was obtained.

The preparation of the above described organic silver salts is described below.

Organic silver salt (1)

The preparation of the benzotriazole silver emulsion is described below.

28 g of gelatin and 13.2 g of benzotriazole were dissolved in 300 ml of water. The solution was then stirred while being kept at a temperature of 40° C. A solution of 17 g of silver nitrate in 100 ml of water was added to the solution over a period of 2 minutes.

The pH value of the benzotriazole silver emulsion was then properly adjusted to effect precipitation such that excess salts were eliminated. Thereafter, the pH value of the emulsion was adjusted to 6.30 to obtain 400 g of a benzotriazole silver emulsion.

Organic silver salt (2)

20 g of gelatin and 5.9 g of 4-acetylaminophenylpropiolic were dissolved in a mixture of 1,000 ml of a 0.1% aqueous solution of sodium hydroxide and 200 ml of ethanol.

The solution was then stirred while being kept at a temperature of 40° C.

A solution of 4.5 g of silver nitrate in 200 ml of water was added to the solution over a period of 5 minutes.

The pH value of the dispersion was properly adjusted to effect precipitation such that excess salts were eliminated. Thereafter, the pH value of the dispersion was adjusted to 6.3 to obtain 300 g of a dispersion of organic silver salt (2).

The preparation of gelatin dispersions of dye-donating substances is described below.

15 g of a yellow dye-donating substance (Y) 7.5 g of a high boiling solvent (1), 0.3 g of a reducer (1) and 0.3 g of a mercapto compound (1) were dissolved in 45 ml of ethyl acetate. The solution was then mixed with 100 g of a 10% aqueous solution of gelatin and 60 ml of a 2.5% aqueous solution of sodium dodecylbenzenesulfonate with stirring. The mixture was then dispersed in a homogenizer at 10,000 rpm over a period of 10 minutes to provide the dispersion of a yellow dye-donating substance as used below.

15 g of a magenta dye-donating substance (M) 7.5 g of a high boiling solvent (1), 0.3 g of a reducer (1) and 0.15 g of a mercapto compound (1) were dissolved in 25 ml of ethyl acetate. The solution was then mixed with 100 g of a 10% aqueous solution of gelatin and 60 ml of a 2.5% aqueous solution of sodium dodecylbenzenesulfonate with stirring. The mixture was then dispersed in a homogenizer at 10,000 rpm over a period of 10 minutes to provide a dispersion of the magenta dye-donating substance.

15 g of a cyan dye-donating substance (C) 7.5 g of a high boiling solvent (1), 0.4 g of a reducer (1) and 0.6 g of a mercapto compound (1) were dissolved in 40 ml of ethyl acetate. The solution was then mixed with 100 g of a 100% aqueous solution of gelatin and 60 ml of 2.5% aqueous solution of sodium dodecylbenzenesulfonate with stirring. The mixture was then dispersed in a homogenizer at 10,000 rpm over a period of 10 minutes to provide a dispersion of the cyan dye-donating substance.

(Y)

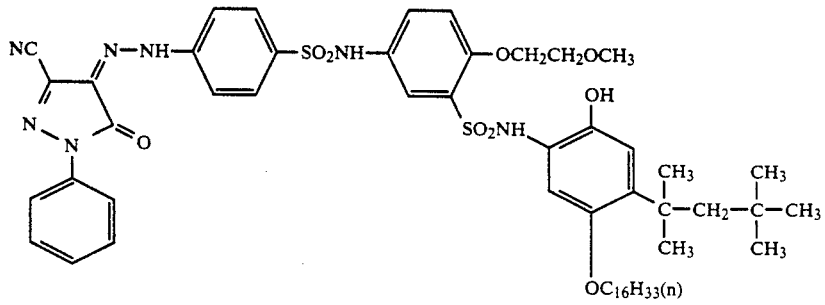

-continued (M)

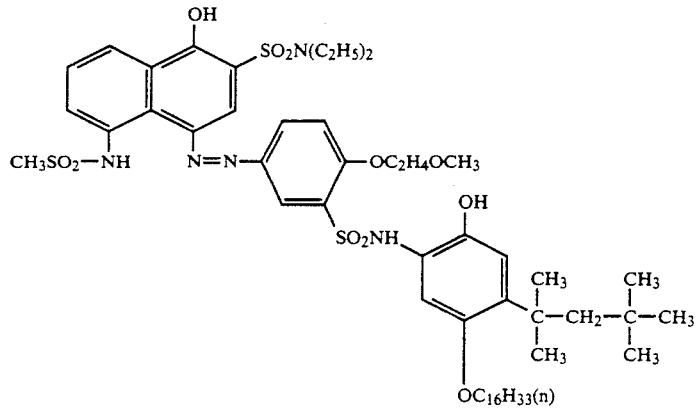

(C)

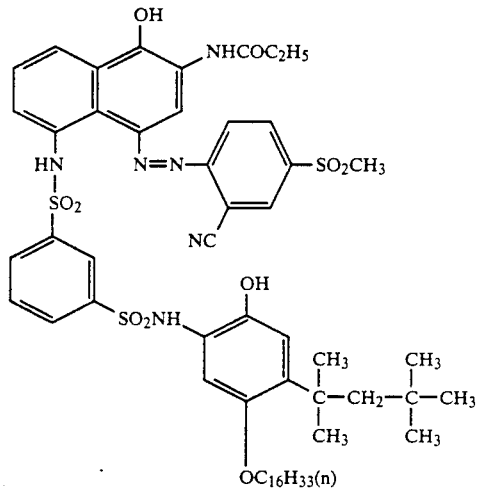

The above described multilayer color light-sensitive material was then exposed to light from a xenon flash lamp for $10^{-4}$ seconds through G, R and IR (infrared) color separation filters having a continuous density gradation.

Water was then supplied to the emulsion surface of the thus exposed light-sensitive material at a rate of 11 ml/m$^2$ through a wire bar. The light-sensitive material was laminated on the image-receiving materials (1) to (3) as described in Example 4 in such a manner that the film surfaces were brought into contact with each other. The lamination was then heated for 25 seconds by means of a heated roller to keep the wet film at a temperature of 93° C. When the light-sensitive material was peeled off of the image-receiving materials, yellow, magenta and cyan images were formed on the image-receiving materials corresponding to the G, R and IR color separation filters.

The maximum density (reflective density) of these color images and the dye residue at the reflective density of 1.0 were measured in the same manner as used in Example 4. The results are shown in Table 8.

TABLE 8

| Color Image | Image-receiving Material | Maximum Density | % Dye Residue | Remarks |
|---|---|---|---|---|
| Yellow | (1) | 2.07 | 0.71 | Comparative |
| " | (2) | 2.08 | 0.71 | " |
| " | (3) | 2.07 | 0.76 | Present Invention |
| Magenta | (1) | 2.33 | 0.68 | Comparative |

TABLE 8-continued

| Color Image | Image-receiving Material | Maximum Density | % Dye Residue | Remarks |
|---|---|---|---|---|
| " | (2) | 2.32 | 0.67 | " |
| " | (3) | 2.34 | 0.74 | Present Invention |
| Cyan | (1) | 2.42 | 0.71 | Comparative |
| " | (2) | 2.41 | 0.71 | " |
| " | (3) | 2.42 | 0.75 | Present Invention |

$$\% \text{ Dye residue} = \frac{\text{Dye density after a 7 day irradiation with xenon light}}{\text{Dye density before irradiation with light}} \times 100$$

As shown in Table 8, the light-sensitive materials comprising the present mordant exhibit a high maximum density and an improved light fastness.

While the invention has been described in detail and with reference to specific embodiments thereof, it will be apparent to one skilled in the art that various changes and modifications can be made therein without departing from the spirit and scope thereof.

What is claimed is:

1. A photographic element comprising a polymer mordant containing a repeating unit derived from an ethylenically unsaturated monomer component containing a tertiary amino group or a quaternary ammonium salt and at least one repeating unit represented by the formula (I) or (II):

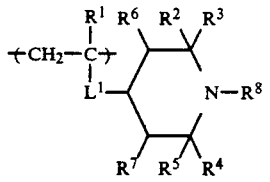

(I)

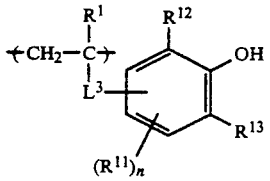

(II)

wherein $R^1$ represents a hydrogen atom or an alkyl group having from 1 to 6 carbon atoms; $R^2$, $R^3$, $R^4$ and $R^5$, which may be the same or different, each represent an alkyl group or substituted alkyl group; $R^6$, $R^7$, and $R^8$, which may be the same or different, each represent hydrogen, an alkyl group or a substituted alkyl group; $R^1$ represents an alkyl group, a substituted alkyl group, an alkoxy group, a substituted alkoxy group, an acylamino group or a halogen atom; $R^{12}$ and $R^{13}$, which may be the same or different, each represent an alkyl group or a substituted alkyl group; $L^1$ and $L^3$, which may be the same or different, each represent a divalent connecting group having from 1 to 20 carbon atoms; and n represents an integer of 0 or 1, wherein the proportion of the repeating unit containing a tertiary amino group or a quaternary ammonium salt in the polymer is in the range of from 10 to 90 mol%, and the proportion of the at least one repeating unit represented by formula (I) or (II) in the polymer is in the range of 10 to 90 mol%.

2. A photographic element as claimed in claim 1, wherein the repeating unit containing a tertiary amino group or a quaternary ammonium salt is represented by the formula (IV):

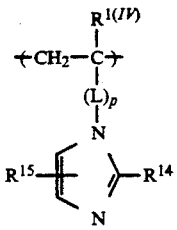

wherein $R^1$, $R^{14}$ and $R^{15}$, which may be the same or different, each represents hydrogen or an alkyl group having from 1 to 6 carbon atoms; L represents a divalent connecting group having from 1 to 20 carbon atoms; and P represents an integer of 0 or 1.

3. A photographic element as claimed in claim 1, wherein the repeating unit containing a tertiary amino group or a quaternary ammonium salt is represented by formula (V):

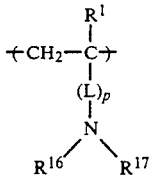

(V)

wherein $R^1$ represents hydrogen or an alkyl group having from 1 to 6 carbon atoms; L represents a divalent connecting group having from 1 to 20 carbon atoms; P represents an integer of 0 or 1; and $R^{16}$ or $R^{17}$, which may be the same or different, each represents an alkyl or substituted alkyl group having from 1 to 12 carbon atoms or an aralkyl or substituted aralkyl group having from 7 to 20 carbon atoms; and $R^{16}$ and $R^{17}$ may be connected to each other to form a ring together with the nitrogen atom bonded thereto.

4. A photographic element as claimed in claim 1, wherein a repeating unit containing a tertiary amino group or a quaternary ammonium salt is represented by formula (VI):

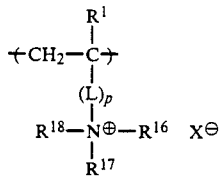

(VI)

wherein $R^1$ represents hydrogen or an alkyl group having from 1 to 6 carbon atoms; L represents a divalent connecting group having from 1 to 20 carbon atoms; P represents an integer of 0 or 1; and $R^{16}$ and $R^{17}$, which may be the same or different, each represents an alkyl or substituted alkyl group having from 1 to 12 carbon atoms or an aralkyl or substituted aralkyl group having from 7 to 20 carbon atoms; and $R^{16}$ and $R^{17}$ may be connected to each other to form a ring together with the nitrogen atom bonded thereto; $R^{18}$ has the same meaning as $R^{16}$; $X^{\ominus}$ represents a monovalent anion; and $R^{16}$ and $R^{17}$, $R^{16}$ and $R^{18}$, or $R^{17}$ and $R^{18}$ may be connected to each other to form a ring together with the nitrogen atom bonded thereto.

5. A photographic element as claimed in claim 1, wherein the repeating unit containing a tertiary amino group or a quaternary ammonium salt is represented by formula (VII):

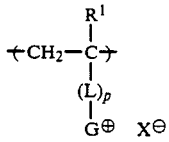

(VII)

wherein $R^1$ represents hydrogen or an alkyl group having from 1 to 6 carbon atoms; L represents a divalent connecting group having from 1 to 20 carbon atoms; P represents an integer of 0 or 1; $X^{\ominus}$ represents a monovalent anion; and $G^{\oplus}$ represents a quaternized aromatic heterocyclic group.

6. A photographic element as claimed in claim 1, wherein the proportion of the repeating unit containing a tertiary amino group or a quaternary ammonium salt in the polymer is in the range of from 10 to 80 mol%;

and the proportion of the at least one repeating unit represented by formula (I) or (II) in the polymer is in the range of from 20 to 80 mol %.

7. A photographic element as claimed in claim 1, wherein the polymer mordant is present in a mordant layer of the photographic element in an amount of from 20 to 80 wt%.

8. A photographic element as claimed in claim 1, wherein said photographic element is a color diffusion transfer element.

9. A photographic element as claimed in claim 1, wherein said photographic element is a heat-developable light-sensitive element comprising a light-sensitive silver halide and a binder provided on a support.

* * * * *